US007899360B2

(12) United States Patent
Kondo et al.

(10) Patent No.: US 7,899,360 B2
(45) Date of Patent: Mar. 1, 2011

(54) IMAGE FORMING APPARATUS, IMAGE FORMING METHOD, AND SUPPORTING MECHANISM

(75) Inventors: Kazuyoshi Kondo, Osaka (JP); Nobuhiko Kita, Osaka (JP); Ryoh Idehara, Hyogo (JP); Tadashi Okano, Ibaraki (JP); Genta Hagiwara, Osaka (JP); Kaoru Tada, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 967 days.

(21) Appl. No.: 11/560,632

(22) Filed: Nov. 16, 2006

(65) Prior Publication Data

US 2007/0110473 A1 May 17, 2007

(30) Foreign Application Priority Data

Nov. 17, 2005 (JP) ..... 2005-332679

(51) Int. Cl.
*G03G 15/00* (2006.01)

(52) U.S. Cl. ..... 399/117; 399/116; 399/125

(58) Field of Classification Search ..... 399/116, 399/117, 125

See application file for complete search history.

(56) References Cited

U.S. PATENT DOCUMENTS 6,483,527 B2 11/2002 Kaneko et al.
2001/0031152 A1* 10/2001 Kaneko et al. ..... 399/116
2007/0166073 A1 7/2007 Idehara et al.
2008/0050146 A1 2/2008 Kita et al.
2008/0292356 A1 11/2008 Furuichi et al.

FOREIGN PATENT DOCUMENTS

| | | |
|---|---|---|
| CN | 1311460 A | 9/2001 |
| JP | 4-269767 | 9/1992 |
| JP | 6-332270 | 12/1994 |
| JP | 11-295952 | 10/1999 |
| JP | 2001-142274 | 5/2001 |
| JP | 2001-290333 | 10/2001 |
| JP | 2002-189324 | 7/2002 |
| JP | 2004-302194 | 10/2004 |

* cited by examiner

*Primary Examiner*—Ryan D Walsh
(74) *Attorney, Agent, or Firm*—Oblon, Spivak, McClelland, Maier & Neustadt, L.L.P.

(57) ABSTRACT

An image forming apparatus includes a first member and second member that are formed of different materials. The first member includes a plurality of first abutting portions. The second member includes a plurality of second abutting portions. One latent image carrier or one holding member abuts with one first abutting portion so as to regulate movements of the latent image carrier in a first direction substantially parallel to a sub scanning direction. One latent image carrier or one holding member abuts with one second abutting portion so as to regulate movements of the latent image carrier in a second direction, which is substantially orthogonal to the first direction.

17 Claims, 10 Drawing Sheets

IMAGE FORMING APPARATUS, IMAGE FORMING METHOD, AND SUPPORTING MECHANISM

CROSS-REFERENCE TO RELATED APPLICATIONS

The present document incorporates by reference the entire contents of Japanese priority document, 2005-332679 filed in Japan on Nov. 17, 2005.

BACKGROUND OF THE INVENTION

1. Field of the Invention

The present invention generally relates to an image forming apparatus and image forming method, and specifically relates to a supporting mechanism that regulates positions of a plurality of latent image carriers in an image forming apparatus.

2. Description of the Related Art

In the image forming apparatus of the type explained above, if there is an error in arrangement pitches of the latent image carriers, the visible images obtained through development on the surface of the respective latent image carriers are transferred onto the transfer member of which the images are displaced in position with respect to each other. This causes a displacement in superposition of the respective visible images on the transfer member.

Also, in general, in the image forming apparatus of this type, a latent-image writing device that writes a latent image on the latent image carriers is placed in a direction orthogonal to a direction in which the latent image carriers are arranged (hereinafter, "orthogonal direction") so that the latent-image forming apparatus faces the latent image carriers. In this configuration as a device that writes a latent image through exposure, as each latent image carrier has a different distance from the latent-image writing device, an error can occur in exposure writing magnification between the latent image carriers. This error causes different dot sizes on the latent image carriers to disturb the final visible image on recording sheets.

Japanese Patent Application Laid-open No. 2002-189324 discloses an image forming apparatus having a plurality of openings formed on its side panel and aligned with predetermined pitches, the openings each respectively corresponding to a latent image carrier fitting therein. In this configuration, the latent image carriers fit in the openings provided on the side panel with the predetermined pitches so as to position accurately both of an arrangement direction and an orthogonal direction. This can decrease an error in arrangement pitches of the latent image carriers and a displacement in superposition of the respective visible images due to such an error. This also can decrease an error in distance between each latent image carrier and the latent-image writing device and an image disturbance due to such an error.

In the image forming apparatus, each latent image carrier fits in the relevant opening, which is a positioning portion on the side panel, intending to position accurately in both of the arrangement direction and the orthogonal direction. Therefore, it cannot individually position in both of these directions. This hinders to reduce cost and weight of the image forming apparatus. In general, it requires the latent image carrier a higher positioning accuracy in the arrangement direction than in the orthogonal direction. This is why a displacement in superposition due to an error in arrangement pitches causes more severe image quality decrease than an image disturbance due to an erroneous distance between latent image carriers and the latent-image writing device. For this reason, it is required to use a positioning portion that is formed of a high-stiffness material with less distortion and deformation such as metal in the arrangement direction to regulate the movement of each latent image carrier for positioning with a relatively high accuracy. On the other hand, it is not necessarily required to use a positioning portion that is formed of a high-stiffness material in the orthogonal direction to regulate the movement of each latent image carrier, so that even a positioning portion formed of a low-stiffness material such as resin can satisfy a desired positioning accuracy. In the image forming apparatus disclosed in Japanese Patent Application Laid-open No. 2002-189324, the latent image carriers are positioned in both of the arrangement direction and the orthogonal direction by single positioning portion of the openings. Therefore, it is impossible to individually select a material of the positioning portion for each of the directions according to the required positioning accuracy. As a result, the whole side panel is formed of sheet metal, which is a high-stiffness material, to meet a higher positioning-accuracy required in the arrangement direction. This leads the apparatus an increase of cost and weight.

SUMMARY OF THE INVENTION

It is an object of the present invention to at least partially solve the problems in the conventional technology.

According to an aspect of the present invention, an image forming apparatus including a plurality of latent image carriers that are disposed in a first direction substantially parallel to a sub scanning direction thereof, and a latent-image writing device that writes latent images on surfaces of the latent image carriers, includes a plurality of first abutting portions, wherein a latent image carrier among the latent image carriers or a holding member among a plurality of holding members, each of which holds a latent image carrier among the latent image carriers, abuts with a first abutting portion among the first abutting portions so as to regulate movements of corresponding latent image carrier in the first direction; a plurality of second abutting portions, wherein a latent image carrier among the latent image carriers or a holding member among the holding members abuts with a second abutting portion among the second abutting portions so as to regulate movements of corresponding latent image carrier in a second direction that is substantially orthogonal to the first direction; a first member that is provided with the first abutting portions; and a second member that is provided with the second abutting portions, the second member being formed separately to the first member, and the second member being formed of different material from that of the first member.

According to another aspect of the present invention, an image forming method of an image forming apparatus that includes a plurality of latent image carriers and a latent-image writing device that writes latent images on surfaces of the latent image carriers, includes abutting the latent image carriers or a plurality of holding members that hold the latent image carriers to first abutting portions so as to regulate movements of the latent image carriers in a predetermined first direction substantially parallel to a sub scanning direction thereof in which the latent image carriers are disposed, and abutting the latent image carriers or the holding members to second abutting portions so as to regulate movements of the latent image carriers in a second direction that is substantially orthogonal to the first direction.

According to still another aspect of the present invention, a supporting mechanism for use in an image forming apparatus that is including a plurality of latent image carriers that are disposed in a first direction substantially parallel to a sub scanning direction thereof, and a latent image writing device that writes latent images on surfaces of the latent image carriers, includes a plurality of first abutting portions, wherein a latent image carrier among the latent image carriers or a holding member among a plurality of holding members, each of which holds a latent image carrier among the latent image carriers, abuts with a first abutting portion among the first abutting portions so as to regulate movements of corresponding latent image carrier in the first direction; a plurality of second abutting portions, wherein a latent image carrier among the latent image carriers or a holding member among the holding members abuts with a second abutting portion among the second abutting portions so as to regulate movements of corresponding latent image carrier in a second direction that is substantially orthogonal to the first direction; a first member that is provided with the first abutting portions; and a second member that is provided with the second abutting portions, the second member being formed separately to the first member, and the second member being formed of different material from that of the first member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an electro-photographic printer (hereinafter, "printer") is explained below as an image forming apparatus to which the present invention is applied.

Figure 1:
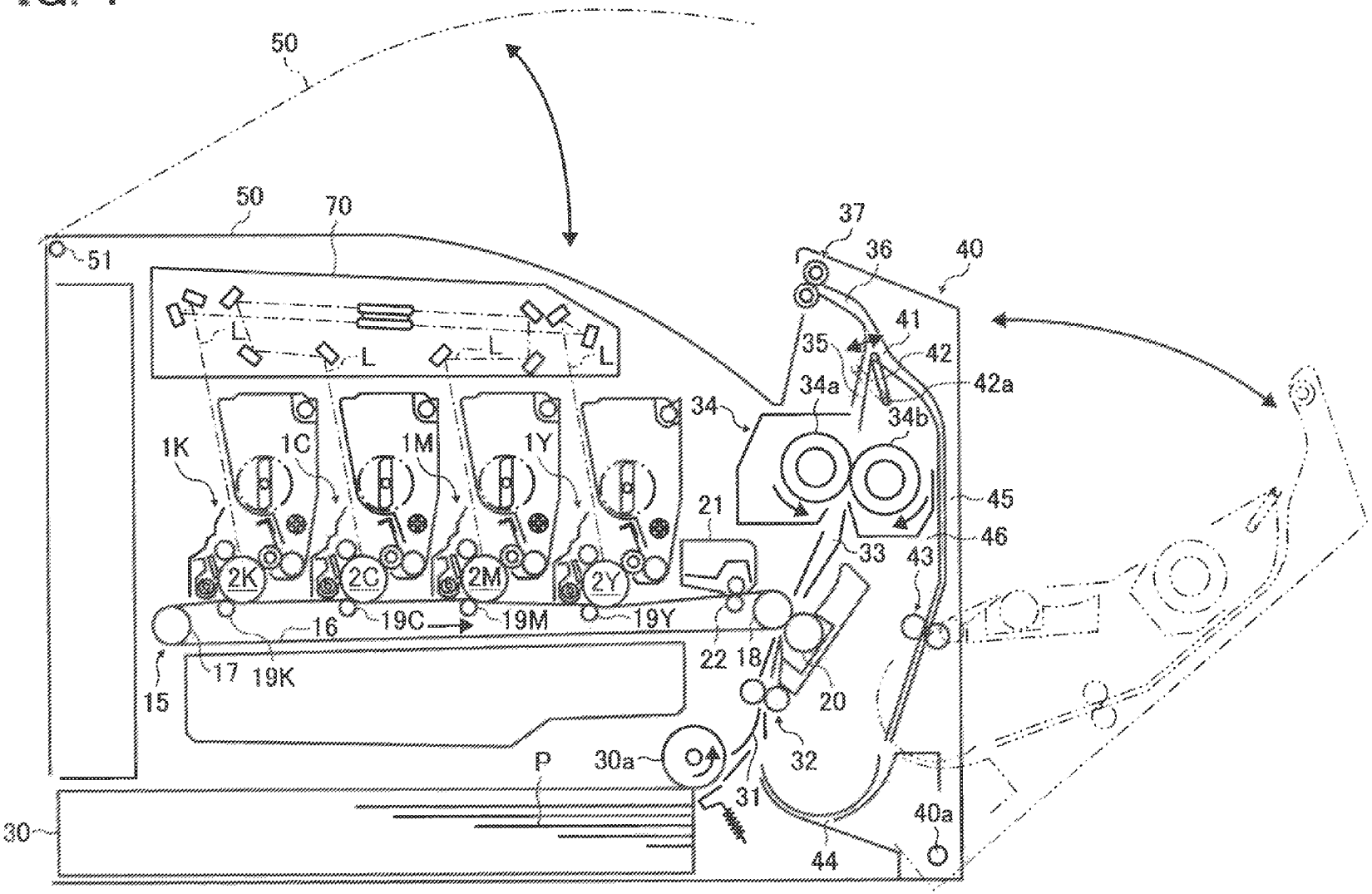
FIG. 1 is a schematic view of a printer according to an embodiment of the present invention.
Figure 2:
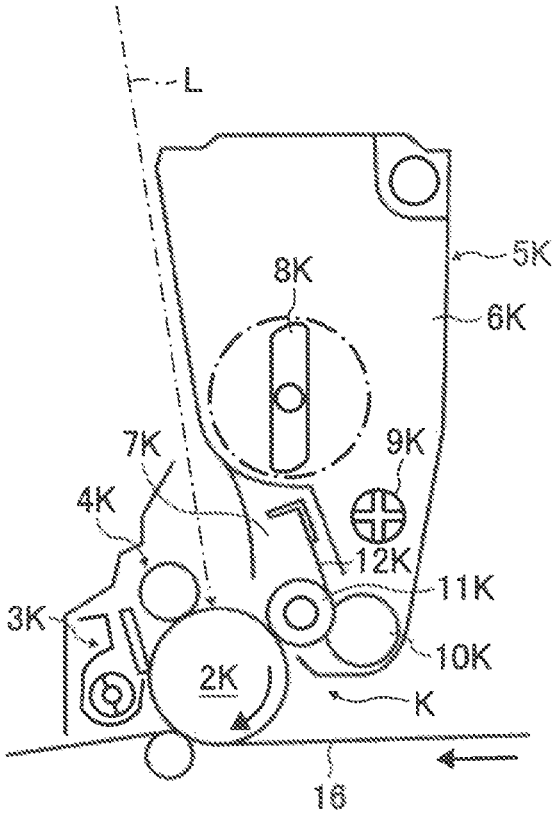
FIG. 2 is an enlarged view of a process unit for K of the printer shown in FIG. 1.

FIG. 1 is a schematic view of a printer according to an embodiment of the present invention. First, the basic configuration of the printer is explained. In this view, the printer includes four process units 1Y, 1M, 1C, and 1K for forming toner images of yellow, magenta, cyan, and black (Y, M, C, and K). These units use different colors of Y, M, C, and K as image formation substances, but have a similar configuration, and are replaced at the time of reaching the end of their life. When the process unit 1K for forming a K toner image is taken as an example, as shown in FIG. 2, the process unit 1K includes a drum-like photosensitive member 2K, which is a latent image carrier, a drum cleaning device 3K, a static eliminating device, not shown, a charging device 4K, a developing device 5K, and others. The process unit 1K, which is an image forming unit, can be removably attached to the printer body, thereby allowing consumable items to be replaced all at once.

The charging device 4K uniformly charges the surface of the photosensitive member 2K rotated in a clockwise direction in the drawing by a rotating unit not shown. The uniformly-charged surface of the photosensitive member 2K is exposed and scanned with laser light L to carry an electrostatic latent image for K. This electrostatic latent image for K is developed to a K toner image by the developing device 5K using K toner not shown, and is then subjected to intermediate transfer on an intermediate transfer belt 16, which will be explained further below. The drum cleaning device 3K removes transfer residual toner attached on the surface of the photosensitive member 2K after the intermediate transfer process. Also, the static eliminating device eliminates residual charges on the photosensitive member 2K after cleaning. With this static elimination, the surface of the photosensitive member 2K is initialized to prepare for the next image formation. Also in the process units for other colors 1Y, 1M, and 1C, toner images of Y, M, and C are formed on respective photosensitive members 2Y, 2M, and 2C, and are subjected to intermediate transfer on the intermediate transfer belt 16, which will be explained further below. Here, a cylindrical drum portion in the photosensitive member 2K is a hollow aluminum-made tube with its front surface covered with an organic photosensitive layer. This drum portion has flanges at both ends in an axial-line direction, each flange having a drum shaft, thereby configuring the photosensitive member 2K.

The developing device 5K as a developing unit includes a vertically-elongated hopper portion 6K containing K toner not shown, and a developing unit 7K. Disposed in the hopper portion 6K are an agitator 8K rotatingly driven by a driving unit not shown, a mixing paddle 9K rotatingly driven vertically under the agitator 8K by a driving unit not shown, a toner supply roller 10K rotatingly driven vertically under the mixing paddle 9K by a driving unit not shown, and others. K toner in the hopper portion 6K moves toward the toner supply roller 10K under its own weight as being mixed by rotational driving of the agitator 8K and the mixing paddle 9K. The toner supply roller 10K includes a metal core made of metal, and a roller portion provided on the surface of the metal core and made of form resin or the like, and rotates so as to cause K toner in the hopper portion 6K to be attached to the surface of the roller portion.

Disposed in the developing unit 7K of the developing device 5K are a developing roller 11K rotating as abutting on the photosensitive member 2K and the toner supply roller 10K, and a thinning blade 12K with its tip abutting on the surface of the developing roller 11K, and others. K toner attached to the toner supply roller 10K in the hopper portion 6K is supplied to the surface of the developing roller 11K between the developing roller 11K and the toner supply roller 10K. The supplied K toner is regulated in film thickness on the roller surface when passing through the abutting position between the roller and the thinning blade 12K according to the rotation of the developing roller 11K. Then, the film-thickness-regulated K toner is attached to an electrostatic latent image for K on the surface of the photosensitive member 2K in a developing area where the developing roller 11K and the photosensitive member 2K are in contact with each other. With this attachment, the electrostatic latent image for K is developed into a K toner image.

FIG. 2 is an enlarged view of a process unit for K of the printer shown in FIG. 1. The process unit for K has been explained by using FIG. 2. Also in the process units 1Y, 1M, and 1C for Y, M, and C, through a process similar to the process explained above, Y, M, and C toner images are formed on the surfaces of the photosensitive members 2Y, 2M, and 2C, respectively.

In FIG. 1 explained above, an optical writing unit 70 is disposed above the process units 1Y, 1M, 1C, and 1K in the vertical direction. The optical writing unit 70, which is a latent-image writing device, optically scans the photosensitive members 2Y, 2M, 2C, and 2K in the process units 1Y, 1M, 1C, and 1K with laser light L emitted from a laser diode based on image information. With this optical scanning, electrostatic latent images for Y, M, C, and K are formed on the photosensitive members 2Y, 2M, 2C, and 2K, respectively. Here, the optical writing unit 70 irradiates the photosensitive members via a plurality of optical lenses and mirrors with laser light (L) emitted from a light source being polarized in a main scanning direction with a polygon mirror rotatingly driven by a polygon motor not shown. Alternatively, optical writing may be performed with light-emitting-diode (LED) light emitted from a plurality of LEDs of an LED array.

Under the process units 1Y, 1M, 1C, and 1K in the vertical direction, a transfer unit 15 is disposed that stretches and endlessly moves the endless intermediate transfer belt 16 counterclockwise shown in FIG. 1. In addition to the intermediate transfer belt 16, the transfer unit 15 includes a driving roller 17, a follower roller 18, four primary transfer rollers 19Y, 19M, 19C, and 19K, a secondary transfer roller 20, a belt cleaning device 21, cleaning back-up rollers 22, and others.

The intermediate transfer belt 16 is stretched by the driving roller 17, the follower roller 18, the cleaning back-up rollers 22, and the primary transfer rollers 19Y, 19M, 19C, and 19K disposed inside the loop of the belt. The intermediate transfer belt 16 is also endlessly moved counterclockwise by rotational force of the driving roller 17 rotatingly driven by a driving unit not shown in the counterclockwise direction in the drawing.

The intermediate transfer belt 16 endlessly moved in the manner explained above is interposed between these four primary transfer rollers 19Y, 19M, 19C, and 19K and the photosensitive members 2Y, 2M, 2C, and 2K. With this interposing, primary transfer nips for Y, M, C, and K are formed where the outer surface of the intermediate transfer belt 16 and the photosensitive members 2Y, 2M, 2C, and 2K are in contact with one another.

To the primary transfer rollers 19Y, 19M, 19C, and 19K, a primary transfer bias is applied by a transfer bias power supply not shown. With this, a transfer electric field is formed between the latent images of the photosensitive members 2Y, 2M, 2C, and 2K and the primary transfer rollers 19Y, 19M, 19C, and 19K. Here, in place of the primary transfer rollers 19Y, 19M, 19C, and 19K, transfer chargers or transfer brushes may be adopted.

When Y toner formed on the surface of the photosensitive member 2Y of the process unit 1Y for Y enters the primary transfer nip for Y according to the rotation of the photosensitive member 2Y, Y toner is subjected to primary transfer from the photosensitive member 2Y onto the intermediate transfer belt 16 by the action of the transfer electric field and a nip pressure. When the intermediate transfer belt 16 with the primary-transferred Y toner image in the manner explained above passes through the primary transfer nips for M, C, and K due to the endless movement, the M, C, and K toner images on the photosensitive members 2M, 2C, and 2K are subjected to primary transfer as being sequentially superposed on the Y toner image. With this superposing primary transfer, four-color toner images are formed on the intermediate transfer belt 16.

The secondary transfer roller 20 of the transfer unit 15 is disposed outside the loop of the intermediate transfer belt 16 to interpose the intermediate transfer belt 16 with the follower roller 18 inside the loop. With this interposing, a secondary transfer nip is formed where the front surface of the intermediate transfer belt 16 and the secondary transfer roller 20 are in contact with each other. To the secondary transfer roller 20, a secondary transfer bias is applied by a transfer bias power supply not shown. With this application, a secondary transfer electric field is formed between the secondary transfer roller 20 and the ground-connected follower roller.

Under the transfer unit 15 in the vertical direction, a paper feeding cassette 30 having accommodated therein a plurality of recording paper sheets P stacked in a bundle is disposed so as to be slidably removable from the cabinet of the printer. The paper feeding cassette 30 causes the recording paper sheet P on top of the bundle to abut on a paper feeding roller 30*a*, which is rotated in the counterclockwise direction in the drawing at predetermined timing, thereby sending the recording paper sheet P to a paper feeding path 31.

At the end of the paper feeding path 31, paired resist rollers 32 are disposed. These paired resist rollers 32 stop their rotations immediately upon interposing therebetween the recording paper sheet P sent from the paper feeding cassette 30. Then, rotational driving is resumed at the timing of synchronizing the interposed recording paper sheet P with the four-color toner images on the intermediate transfer belt 16 in the secondary transfer nip, thereby sending the recording paper sheet P to the secondary transfer nip.

The four-color toner images on the intermediate transfer belt 16 brought into intimate contact with the recording paper sheet P by the secondary transfer nip are collectively subjected to secondary transfer onto the recording paper sheet P under the influence of the secondary transfer electric field and nip pressure, and become a full-color toner image together with white color of the recording paper sheet P. When passes the recording paper sheet P with the full-color toner image formed thereon through the secondary transfer nip, the recording paper sheet P is separated from the secondary transfer roller 20 and the intermediate transfer belt 16 by means of curvature separation. Then, through a post-transfer conveyor path 33, the recording paper sheet S is sent to a fixing device 34, which will be explained further below.

The intermediate transfer belt 16 after passing through the secondary transfer nip, transfer residual toner that is left untransferred onto the recording paper sheet P is attached. This is cleaned from the surface of the belt by the belt cleaning device 21 abutting on the front surface of the intermediate transfer belt 16. The cleaning back-up rollers 22 disposed inside the loop of the intermediate transfer belt 16 back up the belt cleaning by the belt cleaning device 21 from the inside of the loop.

In the fixing device 34, a fixing nip is configured by a fixing roller 34*a*, containing a heating source not shown, such as a halogen lamp, and a pressure roller 34*b* rotating in contact with the fixing roller 34*a* with a predetermined pressure. The recording paper sheet P sent in the fixing device 34 is nipped by the fixing nip so that the surface that carriers an unfixed toner image is fixed to the fixing roller 34*a*. Then, under the influence of heading and pressure, the toner in the toner image is softened, thereby fixing the full-color image.

The recording paper sheet P delivered from the fixing device 34 passes through a post-fixing conveyor path 35 and then reaches a branching point to a paper delivery path 36 and a pre-reverse conveyor path 41. On the side of the post-fixing conveyor path 35, a switching nail 42 is disposed that is rotatingly driven about a rotating shaft 42*a*. This rotation closes or opens the vicinity of the end of the post-fixing conveyor path 35. At the timing of sending the recording paper sheet P from the fixing device 34, the switching nail 42 stops at a rotating position shown in a solid line in the drawing, thereby opening the vicinity of the end of the post-fixing conveyor path 35. Thus, the recording paper sheet P enters from the post-fixing conveyor path 35 into the paper delivery path 36, and is then interposed between paired paper delivery rollers 37.

When one-side printing mode is selected through an input operation onto an operating unit formed of a numeric keypad or the like not shown or through a control signal coming from a personal computer or the like not shown, the recording paper sheet P interposed by the paired paper delivery rollers 37 is delivered as it is to the outside of the apparatus, and is stacked in a stacking unit on the upper surface of an upper cover 50 of the cabinet.

On the other hand, when both-side printing is set, the rear end of the recording paper sheet P conveyed through the paper delivery path 36 with the tip being interposed by the paired paper delivery rollers 37 passes through the post-fixing conveyor path 35, then the switching nail 42 is rotated to a position represented by a one-dot-chain line shown in the drawing to close the vicinity of the rear end of the post-fixing conveyor path 35. Approximately at the same time, the paired paper delivery rollers 37 start to rotate in reverse. Then, the recording paper sheet P is conveyed with its rear end on top this time, and then enters the pre-reverse conveyor path 41.

FIG. 1 shows the printer from the front. The front side in a direction orthogonal to the surface of the drawing represents a front surface of the printer, while the depth side represents a rear surface. Also, the right side of the printer in the drawing represents a right-side surface, and the left side thereof represents a left-side surface. The right end of the printer forms a reversing unit 40 that can be open and close with respect to the cabinet body by rotating about a rotating shaft 40*a*. When the paired paper delivery rollers 37 rotate in reverse, the recording paper sheet P enters the pre-reverse conveyor path 41 of the reversing unit 40 to be conveyed from the upper side to the lower side in the vertical direction. Then, after passing the paired reversing conveyor rollers 43, the recording paper sheet P enters a reversing conveyor path 44 curved in a semicircle. Furthermore, as the recording paper sheet P is conveyed along the curved shape, the recording paper sheet P is turned upside down, and also its traveling direction from the upper side to the lower side of the vertical direction is reversed, thereby causing the recording paper sheet P to be conveyed from lower side to the upper side in the vertical direction. Then, after passing through the paper feeding path 31, the recording paper sheet P re-enters the secondary transfer nip. Then, collective secondary transfer is performed to cause a full-color image to be transferred on the other surface. After that, the recording paper sheet P sequentially passes through the post-transfer conveyor path 33, the fixing device 34, the post-fixing conveyor path 35, the paper delivery path 36, and the paired paper delivery rollers 37, and is then delivered to the outside of the apparatus.

The reversing unit 40 has an outer cover 45 and a rocking member 46. Specifically, the outer cover 45 of the reversing unit 40 is supported so as to rotate about the rotating shaft 40*a* provided to the cabinet of the printer body. With this rotation, the outer cover 45 opens and closes together with the rocking member 46 held therein with respect to the cabinet. As represented by dotted lines in the drawing, when the outer cover 45 opens together with the rocking member 46 therein, the paper feeding path 31, the secondary transfer nip, the post-transfer conveyor path 33, the fixing nip, the post-fixing conveyor path 35, and the paper delivery path 36 formed between the reversing unit 40 and the printer body side are vertically separated into two to be exposed to the outside. With this, a jammed paper sheet in the paper feeding path 31, the secondary transfer nip, the post-transfer conveyor path 33, the fixing nip, the post-fixing conveyor path 35, and the paper delivery path 36 can be easily removed.

Also, with the outer cover 45 being open, the rocking member 46 is supported by the outer cover 45 so as to be rotated about a rocking shaft not shown provided to the outer cover 45. When the rocking member 46 opens with this rotation with respect to the outer cover 45, the pre-reverse conveyor path 41 and the reversing conveyor path 44 are vertically separated that the two be exposed to the outside. With this, a jammed paper sheet can be easily removed, which is jammed in the pre-reverse conveyor path 41 and the reversing conveyor path 44.

An upper cover 50 of the cabinet of the printer is rotatably supported about a shaft member 51 as shown in an arrow in the drawing, and is rotated in the counterclockwise direction in the drawing to be open to the cabinet. Then, an upper opening of the cabinet is largely exposed.

Figure 3:
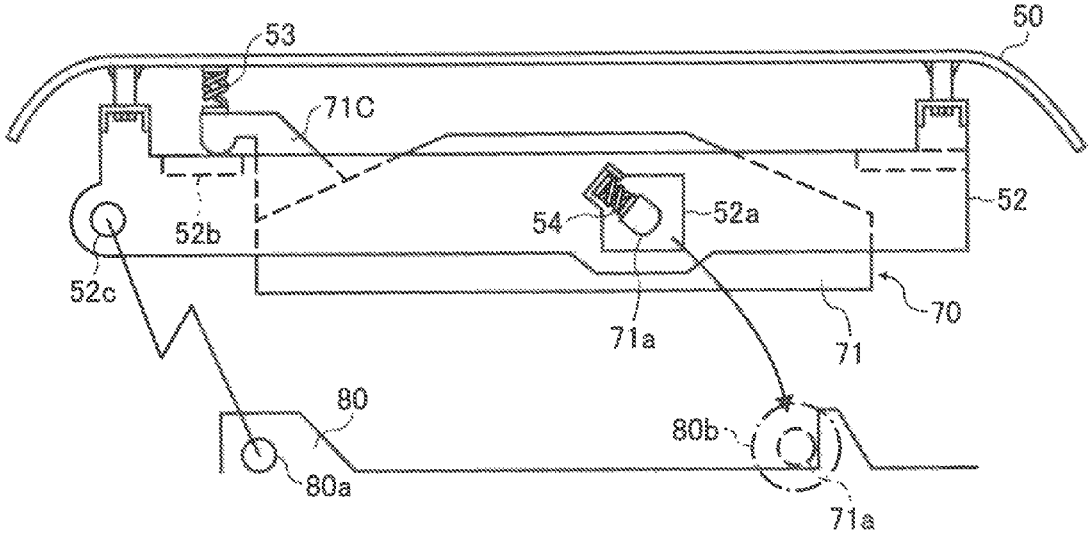
FIG. 3 is an enlarged view of an upper cover and surroundings in the printer shown in FIG. 1.

FIG. 3 is an enlarged view of an upper cover and surroundings in the printer shown in FIG. 1. It shows the configuration of the upper cover 50 and its surroundings in the printer. In the drawing, a cover frame 52 is fixed to the rear side of the upper cover 50, and holds the optical writing unit 70. In more detail, the cover frame 52 has a front plate and rear plate, not shown, facing each other a predetermined distance away from each other in a direction from the front to rear of the printer, which is a direction orthogonal to the surface of the drawing, and a rib not shown that connects these plates together. The front and rear plates each have an opening 52*a* that is rectangular shaped at a position facing each other. On the other hand, the optical writing unit 70 has a first reference position member 71*a* cylindrical-shaped protruding from a front wall of a casing 71. Although not shown, the optical writing unit 70 also has a cylindrical second reference position member protruding from a rear wall of the casing 71. These reference position members are provided so as to extend on the same axis. The optical writing unit 70 is positioned between the front plate and the rear plate of the cover frame 52. The first reference position member 71*a* protruding from the front wall of the casing 71 penetrates through the opening 52*a* provided on the front plate of the cover frame 52. The second reference position member, not shown, protruding from the rear wall of the casing 71 penetrates through the opening provided on the rear plate of the cover frame 52. Furthermore, the optical writing unit 70 has a hook portion 71*c* on an upper surface of the left end of the casing 71. This hook portion 71*c* is biased by a coil spring 53 fixed to the lower surface of the upper cover 50 in a direction away from the upper cover 50 to collide with a colliding portion 52*b* of the cover frame 52. In this manner, the optical writing unit 70 is supported by the cover frame 52 with the first reference position member 71*a* at the front end and the second reference position member at the back end penetrating through the openings of the cover frame 52 and with the hook portion 71*c* at the left end colliding with the colliding portion 52*b* of the cover frame 52. Here, the cover frame 52 may be integrally molded with the body of the upper cover 50.

The opening 52*a* provided on the front plate of the cover frame 52 and the opening provided on the rear plate not shown have a size considerably larger than diameters of the first reference position member 71*a* and the second reference position member not shown of the optical writing unit 70. The optical writing unit 70 is floatingly held by the cover frame 52 within a clearance between the opening 52*a* of the front plate and the first reference position member 71*a* and a clearance between the opening of the rear panel and the second reference position member.

The upper cover 50 has a shaft hole 52*c* at the left end of each of the front and rear plates of the cover frame 52. On the other hand, a front panel 80 is provided to stand near the front surface in the cabinet of the printer. A rear panel, not shown, is also provided to stand at the rear side of the front panel 80 and face the front panel 80 with a predetermined distance apart therefrom. Also, a shaft hole 80*a* for the front panel 80 is provided near the upper-left corner of each of the front panel 80 and the rear panel. The left end of the cover frame 52 of the upper cover 50 is inserted between the front panel 80 and the rear panel. In this state, the shaft member 51 shown in FIG. 1 is set so as to sequentially penetrate through the shaft hole 80*a* of the front panel 80, the shaft hole 52*c* of the front plate of the cover frame 52, the shaft hole of the rear panel, and the shaft hole of the rear plate of the cover frame 52. With this, the upper cover 50, the cover frame 52, and the optical writing unit 70 are supported by the front panel 80 or the rear panel in the cabinet so as to rotate about the shaft member 51, as shown in FIG. 1.

The optical writing unit 70 held by the cover frame 52 can move, according to the opening and closing operation of the upper cover 50, between a waiting position where the optical writing unit 70 does not face any one of the horizontally-aligned process units 1Y, 1M, 1C, and 1K and an operating position where it faces these units.

Here, a hook not shown is provided at right end of each of the front plate and the rear plate of the cover frame 52. With the upper cover 50 being closed, these hooks are engaged with expansion pins not shown that are provided on the front panel 80 and the rear panel in the cabinet. With this engagement, the movement at the right end of the cover frame 52 is stopped. The movement at the left end of the cover frame 52 is regulated by the shaft member 51 shown in FIG. 1.

On the front panel of the cover frame 52, a first biasing coil spring 54 as a first biasing portion is fixed that biases the first reference position member 71*a* penetrating through the opening 52*a* of the cover frame 52 in a slanting direction from upper left to lower right. In FIG. 3, the first reference position member 71*a* is depicted at the center position of the opening 52*a*. In the state where the upper cover 50 is open, the first reference position member 71*a* biased by the first biasing coil spring 54 is biased onto the lower right corner of the inner wall of the opening 52*a*. In this sate, the optical writing unit 70 is held by the cover frame 52. Here, although not shown, on the rear panel of the cover frame 52, a second biasing coil spring as a second biasing portion is fixed that biases the second reference position member penetrating through the opening in a slanting direction from upper left to lower right when viewed from the apparatus body.

Figure 4:
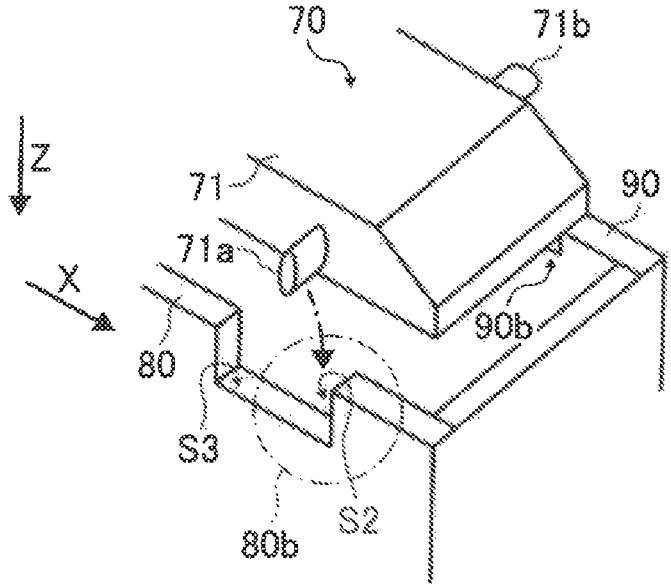
FIG. 4 is a perspective view of a right end in a cabinet of the printer shown in FIG. 3.
Figure 5:
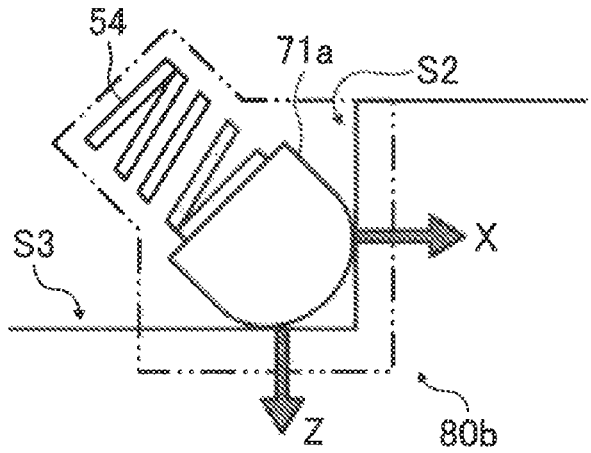
FIG. 5 is a schematic view of a first reference position member of an optical writing unit and surroundings shown in FIG. 3.

FIG. 4 is a perspective view of a right end in a cabinet of the printer shown in FIG. 3. FIG. 5 is a schematic view of a first reference position member of an optical writing unit and surroundings shown in FIG. 3.

On the other hand, as shown in FIGS. 4 and 5, a first positioning portion 80*b* is provided on an upper portion of the front panel 80 in the cabinet for positioning the optical writing unit 70 at the operating position according to the closure of the upper cover. This first positioning portion 80*b* has two abutting surface on which the first reference position member 71*a* biased by the first biasing coil spring 54 in FIG. 3. One is a third-direction-regulating abutting surface S3 for regulating the movement of the first reference position member 71*a* in a direction represented by an arrow X in the drawing. The direction represented by the arrow X in the drawing is orthogonal to the direction from front to rear, orthogonal to a direction of the drawing surface, which is a latent-image writing direction, main scanning direction, of the optical writing unit 70, and is identical to the arrangement direction of the process units, photosensitive members. The other is a second-direction-regulating abutting surface S2 for regulating the movement of the first reference position member 71*a* in a direction represented by an arrow Z in the drawing.

Here, the first reference position member 71*a* of the optical writing unit 70 moves so as to draw an arc about the shaft member 51 shown in FIG. 1 explained above When abutting on the second-direction-regulating abutting surface S2 of the first positioning portion 80*b* shown in FIG. 5 shows the first reference position member 71*a* moves in the direction represented by the arrow Z in the drawing.

Figure 8:
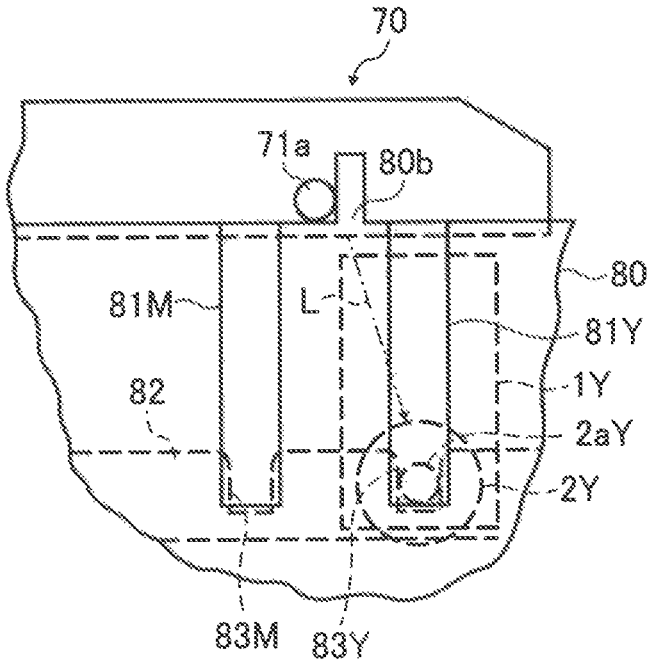
FIG. 8 is another partial front view from the front side of the printer shown in FIG. 1.

In FIG. 3 explained above, the first biasing coil spring 54 biases the first reference position member 71*a* of the optical writing unit 70 positioned at the operating position with the upper cover 50 being closed, so as to cause the first reference position member 71*a* to collide with both of the third-direction-regulating abutting surface S3 and the second-direction-regulating abutting surface S2 of the first positioning portion 80*b* shown in FIG. 8. With this, the front end of the optical writing unit 70 at the operating position is positioned in the X direction and also in the Z direction.

Also, in FIG. 4 explained above, a second positioning portion 90*b* is provided on an upper portion of a rear panel 90 disposed at rear of the front panel 80 for positioning the optical writing unit 70 at the operating position according to the closure of the upper cover. This second positioning portion 90*b* has two abutting surface on which a second reference position member 71*b* biased by the second biasing coil spring not shown. One is a third-direction-regulating abutting surface for regulating the movement of the second reference position member 71*b* in a direction represented by the arrow X in the drawing. Other is a second-direction-regulating abutting surface for regulating the movement of the second reference position member 71*b* in a direction represented by the arrow Z in the drawing.

The second biasing coil spring fixed to the rear plate not shown of the cover frame 52 biases the second reference position member 71*b* of the optical writing unit 70 at the operating position so as to cause the second reference position member 71*b* to collide with both of the third-direction-regulating abutting surface and the second-direction-regulating abutting surface S2 the second positioning portion 90*b*. With this, the rear end of the optical writing unit 70 at the operating position is positioned in the X direction and also in the Z direction.

In the printer with such a configuration, the optical writing unit 70 is moved from the operating position to the waiting position as required through the rotation of the upper cover 50, thereby causing the optical writing unit 70 to be considerably separated away from the process units 1Y, 1M, 1C, and 1K including the photosensitive members and their peripheral devices. With this separation, the process units 1Y, 1M, 1C, and 1K are considerably exposed, thereby increasing maintenance ability.

Also, the reference position member of the optical writing unit 70 at the operating position is caused to abut on the positioning portion in the cabinet by a biasing force of the biasing coil spring. With this, the optical writing unit 70 is positioned with respect to each photosensitive member in the cabinet. Therefore, even if the cover frame 52 as a holding member movably holding the optical writing unit 70 and also moving itself moves with a rattle to some degree, the optical writing unit 70 can be positioned with respect to each of the photosensitive member in the cabinet at the operating position, thereby suppressing degradation in accuracy of the writing position of the optical writing unit 70.

Also, the first reference position member 71*a* is provided at one end, front end, of the latent-image writing direction, the direction from front to rear, of the optical writing unit 70. And the second reference position member 71*b* is provided at the other end, rear end. Both ends of these members are caused to abut on the third-direction-regulating abutting surface S3, thereby achieving the following. That is, both ends of the optical writing unit 70 in the latent-image writing direction are positioned in the direction represented by the arrow X in the drawing, the direction orthogonal to the latent-image writing direction and identical to the moving direction on the surface of the photosensitive member at the optical writing position. With this, the latent-image writing direction on the surface of the photosensitive member is accurately positioned to the direction orthogonal to the surface moving direction to suppress a skew in the latent-image writing direction on the surface of the photosensitive member, a skew from a direction orthogonal to the surface moving direction, thereby preventing a skew of the image on the paper surface.

Furthermore, both ends of the optical writing unit 70 in the latent-image writing direction are caused to abut on the second-direction-regulating abutting surface S2 for positioning in the moving direction, thereby also suppressing a skew of the optical writing unit 70 from one end to the other end.

In the configuration of the present printer where toner images formed on the photosensitive members for respective colors 2Y, 2M, 2C, and 2K aligned in the predetermined direction are superposed on the intermediate transfer belt 16 as a transfer member, parallelism of the respective photosensitive members in the axial direction and parallelism of the respective photosensitive members in the axial direction and the optical scan line by the optical writing unit 70 are displaced, a displacement in superposition occurs to the toner images for the respective colors. The amount of displacement, although depending of the amount of displacement in parallelism, may be on the order of 200 micrometers. It is ideal that the axial direction of each photosensitive member and the optical scan line of the optical writing unit 70 are parallel to each other, and they forms a right angle with respect to a paper passing direction. In this case, no displacement in superposition occurs. However, it is difficult to position each photosensitive member, the optical writing unit 70, and the transfer unit 15 so as to have an ideal positional relation.

Therefore, various schemes of adjusting the parallelism of the laser scan line with respect to the photosensitive members through software or mechanically have been studied. Also, an error in distance from the optical writing unit 70 in each photosensitive member can be adjusted through software by adjusting a scanning-start timing or a magnification operation. However, as for a displacement in superposition due to an error in parallelism of each photosensitive member in the axial direction, optimization by the adjustment through software is difficult. Moreover, mechanical adjustment will increase cost. Therefore, to suppress a displacement in superposition, it is important to accurately position the arrangement pitches at both ends of each photosensitive member in the axial direction to sustain the parallelism of the respective photosensitive members with high accuracy.

Next, a characteristic configuration of the present printer is explained.

Figure 6:
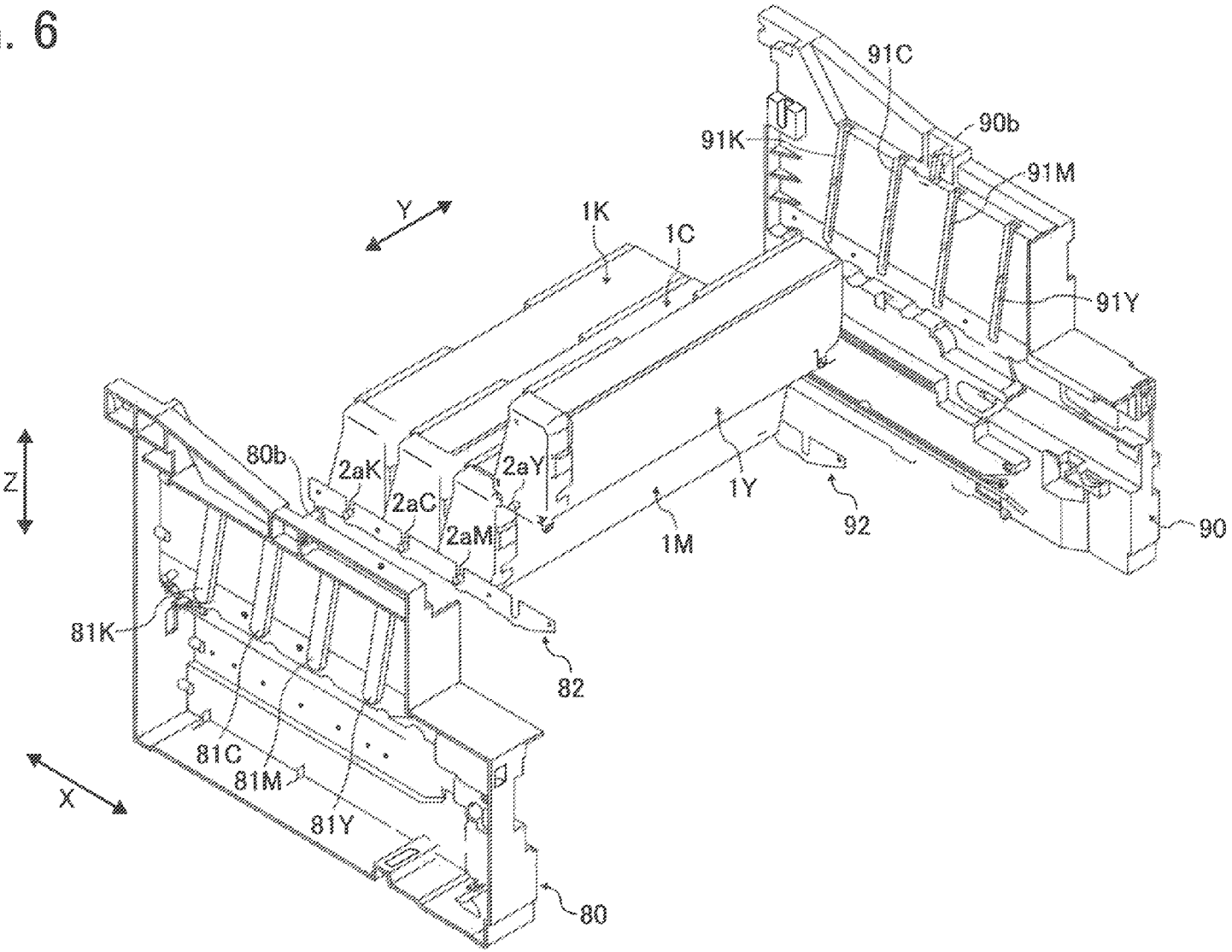
FIG. 6 is a partial exploded perspective view of the printer shown in FIG. 1.

FIG. 6 is a partial exploded perspective view of the printer shown in FIG. 1. In FIG. 6 is shown the internal configuration of the present printer. In the present printer, the front panel 80 and the rear panel 90 are provided to stand in the cabinet not shown and face each other a predetermined distance away from each other in a direction from front to rear, a direction represented by an arrow Y in the drawing. The front panel 80 does not have a simple flat plate shape, but has a complex shape formed with embossed concave and convex portions, each portions integrally molded with a mold by using the same resin material. The same goes for the rear panel 90.

The front panel 80 has a facing surface with respect to the rear panel 90. On this facing surface, four guide grooves 81Y, 81M, 81C, and 81K extending from an upper end to an lower end are formed so as to be aligned with predetermined pitches in a direction represented by an arrow X in the drawing. The upper ends of these guide grooves 81Y to 81K are open upward. Also, the lower ends of these guide grooves 81Y to 81K each form a bearing that slidably and rotatably receives and makes contact with a relevant one of front drum shafts 2*a*Y, 2*a*M, 2*a*C, and 2*a*K. Also, the rear panel 90 has a facing surface with respect to the front panel 80. On this facing surface, formed are guide grooves 91Y, 91M, 91C, and 91K similar to the above. However, these guide grooves 91Y to 91K each form a bearing that slidably and rotatably receives not the relevant one of the front drum shafts 2*a*Y to 2*a*K of the photosensitive members not shown, but a relevant one of rear drum shafts not shown on the other side. Here, a direction represented by an arrow X in the drawing is identical to the direction in which the four photosensitive members not shown are arranged.

On the facing surface of the front panel 80 facing the rear panel 90, a front pitch positioning member 82 made of sheet metal is fixed by a screw. This front pitch positioning member 82 has four notches extending from the upper end to the lower end, and is formed so as to be aligned with predetermined pitches in the direction represented by the arrow X in the drawing. Also on the facing surface of the rear panel 90 facing the front panel 80, a similar rear pitch positioning member 92 is fixed by a screw.

Here, the process units 1Y, 1M, 1C, and 1K have the front drum shafts 2*a*Y, 2*a*M, 2*a*C, and 2*a*K of the photosensitive members not shown, respectively, rotatably protrude from the front wall of the casing. Also, although not shown in the drawing, the process units 1Y, 1M, 1C, and 1K have the rear drum shafts of the photosensitive members 2Y, 2M, 2C, and 2K, respectively, rotatably protrude from the rear wall of the casing.

Figure 7:
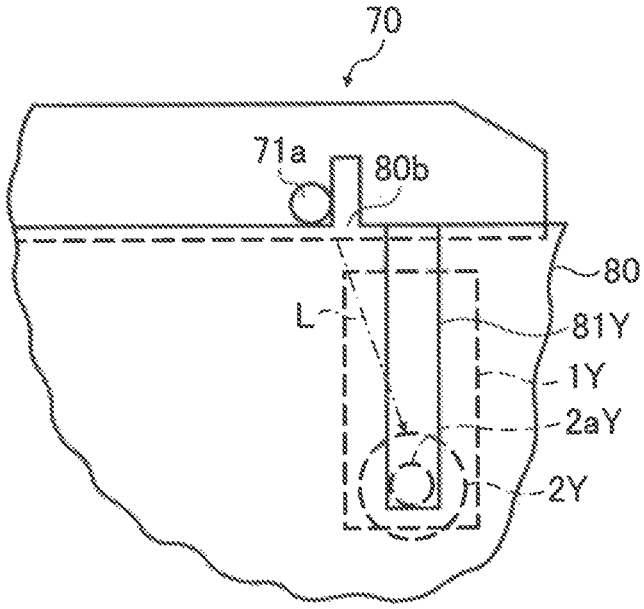
FIG. 7 is a partial front view from the front side of the printer shown in FIG. 1.

FIG. 7 is a partial front view from the front side of the printer shown in FIG. 1. FIG. 7 shows a part of the optical writing unit 70, a part of a front panel 80 with the front pitch positioning member being removed therefrom. To set the process unit 1K for Y to the printer, at the front end of the process unit 1K, the front drum shaft 2*a*Y of the photosensitive member 2Y protruding from the front wall of the casing is inserted in the guide groove 81Y for Y of the front panel 80 from its upper side. At the same time, the rear drum shaft not shown of the photosensitive member 2Y protruding from the rear wall of the casing is inserted in the guide groove for Y of the rear panel not shown from its upper side. Then, the process unit 1K is lowered downward in a gravity direction so that the front drum shaft 2*a*Y inserted in the upper end of the guide groove 81Y for Y on the front panel 80 and the rear drum shaft inserted in the upper end of the guide groove for Y on the rear panel are slidably moved from an upper side to a lower side in the vertical direction along a direction in which the groove extends. With this, the front drum shaft 2*a*Y stops at the lower end of the guide groove 81Y on the front panel 80 and the rear drum shaft stops at the lower end of the guide groove on the rear panel, thereby blocking a further sliding movement. In this state, the front drum shaft 2*a*Y of the photosensitive member 2Y is slidably and rotatably supported by the lower end of the guide groove 81Y on the front panel 80, and also the rear drum shaft not shown is slidably and rotatably supported by the lower end of the guide groove on the rear panel. Then, the photosensitive member 2Y and the process unit 1K in the vertical direction are positioned, of which the direction represented by the arrow Z in FIG. 6. Here, the vertical direction is a direction, the direction represented by the arrow Z in FIG. 6, orthogonal to the direction in which the photosensitive members are arranged, the direction represented by the arrow X in FIG. 6. Therefore, the lower end of the guide groove 81Y for Y on the front panel 80 functions as a second abutting portion that abuts on the front drum shaft 2*a*Y of the photosensitive member 2Y tending to move in the orthogonal direction and regulates the movement of the photosensitive member 2Y in the orthogonal direction. Also, although not shown, the lower end of the guide groove 91Y for Y on the rear panel 90 similarly functions as a second abutting portion.

As shown in FIG. 6 explained above, the front panel 80 is also formed with the guide grooves 81M, 81C, and 81K for M, C, and K, respectively, in addition to the guide groove 81Y for Y. Furthermore, the rear panel 90 is also formed with the guide grooves 91M, 91C, and 91K for M, C, and K, respectively, in addition to the guide groove 91Y for Y. In the photosensitive members 2M, 2C, and 2K for M, C, and K, as with the photosensitive member 2Y for Y, slidably and rotatably supported are their front drum shafts 2*a*M, 2*a*C, and 2*a*K at the front end, in contact with the lower ends of the guide grooves 81M, 81C, and 81K, respectively, on the front panel 80. At the same time, the rear drum shafts at the front end are slidably and rotatably supported in contact with the lower ends of the guide grooves 91M, 91C, and 91K, respectively, on the rear panel 90. With this, the lower ends of the guide grooves 81M, 81C, and 81K for M, C, and K on the front panel 80 and the lower ends of the guide grooves 91M, 91C, and 91K for M, C, and K on the rear panel 90 function as second abutting portions that make contact with the rear drum shafts of the photosensitive members 2M, 2C, and 2K, tending to move in the orthogonal direction and regulate the movement of the photosensitive members 2M, 2C, and 2K.

Here, the printer front end where the front panel 80 is disposed is one end in the optical scanning direction, main scanning direction, of the optical writing unit 70 in each of the photosensitive members 2Y, 2M, 2C, and 2K. Also, the printer rear end where the rear panel 90 is disposed is the other end in the optical scanning direction in each of the photosensitive members. Therefore, the front panel 80 functions as a member having a plurality of second abutting portions, the lower ends of the guide grooves, in contact with the front drum shafts 2*a*Y, 2*a*M, 2*a*C, and 2*a*K, which are one ends of the four photosensitive members 2Y, 2M, 2C, and 2K. Also, the rear panel 90 functions as a member having the second abutting portions in contact with the rear drum shafts, which are the other ends of the four photosensitive members.

Furthermore, the four guide grooves 81Y, 81M, 81C, and 81K on the front panel 80 have a width larger than the diameter of each of the front drum shafts 2*a*Y, 2*a*M, 2*a*C, and 2*a*K of the photosensitive members 2Y, 2M, 2C, and 2K. Therefore, the front drum shafts 2*a*Y, 2*a*M, 2*a*C, and 2*a*K are supported by the lower ends of the grooves with a rattle to some degree in the arrow-X direction, the direction in which the photosensitive members are arranged.

The lower ends of the guide grooves 81Y, 81M, 81C, and 81K on the front panel 80 and the lower ends of the guide grooves 91Y, 91M, 91C, and 91K on the rear panel 90 are under the load of the process units 1Y, 1M, 1C, and 1K, respectively. Also, the front panel 80 and the rear panel 90 have a complex shape as shown in the drawing. Therefore, the guide grooves preferably have a long length in a drum axis direction, groove depth, to some degree, such as 5 millimeters, in stead of a thin-thickness dimension such as that of a sheet metal. Otherwise, the drum shaft is received at a portion of an extremely small area, thereby causing the lower end of each guide groove and the drum shaft to wear badly. Also, even if the front panel 80 and the rear panel 90 are made of resin, the configuration of resin material is preferably improved by adding an additive, such as a filler. Only in view of excellent strength, the metal material is preferable. However, since the metal material is inferior in moldability, it is difficult to use the metal material to mold the front panel 80 and the rear panel 90 in a complex shape as shown in the drawing.

FIG. 8 is another partial front view from the front side of the printer shown in FIG. 1. FIG. 8 shows a part of the optical writing unit 70, a part of the front panel 80 with the front pitch positioning member 82 being mounted thereon. As depicted in the drawing, the front pitch positioning member 82 is fixed to the front panel 80 so that the lower ends of notches 83Y and 83M for Y and M are located lower in the vertical direction than the lower ends of the guide grooves 81Y and 81M for Y and M on the front panel 80. Therefore, the front drum shafts of the photosensitive members for Y and M are supported by the lower ends of the guide grooves 81Y and 81M located upper in the vertical direction. The notches for C and K not shown of the front pitch positioning member 82 are also located lower than the lower ends of the guide grooves, and therefore the front drum shafts of the photosensitive members for C and K are also supported by the lower ends of the guide grooves located upper in the vertical direction.

The notch 83Y for Y of the front pitch positioning member 82 is open upward in the vertical direction, and therefore does not have an upper wall, but has three inner walls, that is, a left inner wall, a right inner wall, and a bottom wall. A wall extending in the vertical direction on the left in the drawing is the left inner wall. A wall extending in the vertical direction on the right in the drawing is the right inner wall. A wall extending in the horizontal direction in the drawing is the bottom wall. Of these walls, the bottom wall and the right wall are not in contact with the front drum shaft 2*a*Y, but the left wall is in contact with the front drum shaft 2*a*Y tending to move from right to left in the drawing. This is because the front drum shaft 2*a*Y of the photosensitive member 2Y tends to move from right to left in the drawing in the X direction, which is the direction in which the photosensitive members are arranged, due to a reason, which will be explained further below. Thus, the left wall of the notch 83Y for Y of the front pitch positioning member 82 functions as a first abutting portion that makes contact with the front drum shaft 2*a*Y of the photosensitive member 2Y tending to move in a predetermined direction, that is, the photosensitive-member arrangement direction, direction represented by the arrow X, and regulates the movement of the photosensitive member 2Y in the photosensitive-member arrangement direction. Although not shown, the left walls of the notches for M, C, and K of the front pitch positioning member 82 each similarly function as a first abutting portion. Therefore, the front pitch positioning member 82 functions as a member having a plurality of first abutting portions each in contact with the front drum shaft at the front side, which is one end in the optical scanning direction of the plurality of the photosensitive members 2Y, 2M, 2C, and 2K.

By using FIG. 8, the case has been explained in which the movement of each photosensitive member in the arrangement direction is regulated by the front pitch positioning member 82 at the printer front end. Also, in the rear pitch positioning member 92 depicted in FIG. 6, left walls of notches for Y, M, C, and K are brought into contact with the rear drum shafts of the photosensitive members 2Y, 2M, 2C, and 2K, respectively. Therefore, the rear pitch positioning member 92 also functions as a member having the first abutting portions each in contact with the rear drum shaft at the rear side, which is the other end in the optical scanning direction of the plurality of the photosensitive members 2Y, 2M, 2C, and 2K.

In the printer with such a configuration, the front pitch positioning member 82 and the rear pitch positioning member 92 each having the first abutting portions for positioning each of the photosensitive members 2Y, 2M, 2C, and 2K in the arrangement direction, direction represented by the arrow X, are provided separately from the front panel 80 and the rear panel 90 each having the second abutting portions for positioning each of the photosensitive members in the orthogonal direction, direction represented by the arrow Z. With this, for a combination of the front pitch positioning member 82 and the front panel 80 and a combination of the rear pitch positioning member 92 and the rear panel 90, different materials can be used. Therefore, in the present printer, as for the arrangement direction that requires positioning with a higher accuracy, the front pitch positioning member 82 and the rear pitch positioning member 92 made of sheet metal with a relatively high stiffness are used for positioning of each of the photosensitive members. On the other hand, as for the orthogonal direction that does not require positioning with an accuracy as high as that in the arrangement direction, the front panel 80 and the rear panel 90 made of resin with a relatively low stiffness are used for positioning of each of the photosensitive members. By using the front panel 80 and the rear panel 90 made of resin instead of metal, it is possible to achieve a reduction in cost and weight of the apparatus.

Also, in the present printer, by using the pitch positioning member 82 and the rear pitch positioning member 92 made of sheet metal with a relatively high stiffness for positioning of each of the photosensitive members 2Y, 2M, 2C, and 2K in the arrangement direction, an error in arrangement pitches of the respective photosensitive members can be suppressed to +0.1 millimeters at both front and rear sides.

The front pitch positioning member 82 and the rear pitch positioning member 92 are made of a plate-like metal member having a thickness, a length in a direction identical to the photosensitive-member-shaft direction, of 0.3 millimeters to 3.0 millimeters, preferably, 0.8 millimeters to 2.0 millimeters. In the present printer, a steel sheet, Steel, Electrogalvanized, ColdRolled, Coil (SECC), having a thickness of 1.2 millimeters and with its surface being electrogalvanized is used. Here, in addition to the viewpoint of performing positioning in the orthogonal direction by a member different from the pitch positioning members, also from the viewpoint of preventing the surface in the thickness direction of the pitch positioning members having a relatively thin film thickness of 1.2 millimeters from being in contact with the drum shaft, the bottom walls of the notches 83Y to 83K under gravity of the process units are not in contact with the drum shafts.

Furthermore, in the present printer, positioning in the arrangement direction, the direction represented by the arrow X, and the orthogonal direction, the direction represented by the arrow Z, are performed at one end and the other end in the optical scanning direction of each photosensitive member. With this, a displacement in parallelism on the plane, X plane in the arrangement direction and a displacement in parallelism on the plane, X plane, in the orthogonal direction of each photosensitive member can be both suppressed.

Figure 9:
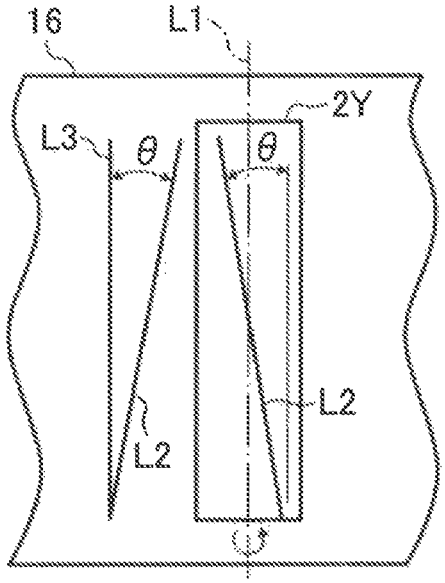
FIG. 9 is a schematic view from top for explaining a photosensitive member and an intermediate transfer belt of the intermediate transfer belt in the printer shown in FIG. 1.
Figure 10:
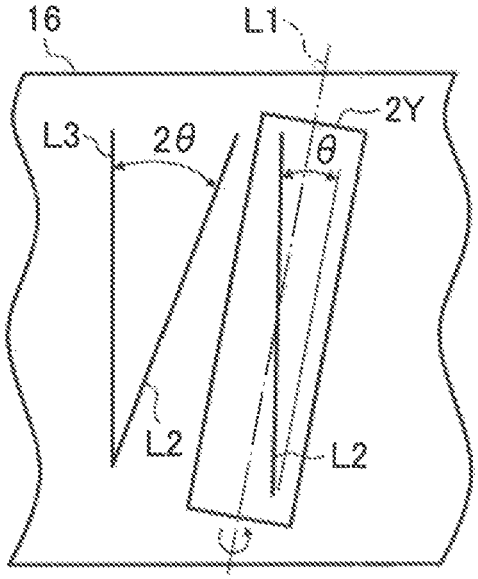
FIG. 10 is another schematic view from top for explaining a photosensitive member and the intermediate transfer belt in the printer shown in FIG. 1.

FIG. 9 is a schematic view from top for explaining a photosensitive member and an intermediate transfer belt of the intermediate transfer belt in the printer shown in FIG. 1. FIG. 10 is another schematic view from top for explaining a photosensitive member and the intermediate transfer belt in the printer shown in FIG. 1.

To suppress a displacement in superposition of toner images for respective colors with respect to the intermediate transfer belt 16, it is very important to suppress displacements in parallelism of the respective photosensitive members in this manner. This is because of a reason explained below. That is, if the photosensitive members are each disposed with high accuracy, the parallelism between the axial direction of each photosensitive member and a direction orthogonal to the conveying direction on the surface of the transfer member, here in the present printer, a width direction of the intermediate transfer belt, can be easily set with high accuracy. Here, it is assumed that a relation among the photosensitive member 2Y, the intermediate transfer belt 16, and the optical scan line of the optical writing unit 70 is as depicted in FIG. 9. In this drawing, the surface of the intermediate transfer belt 16 moves from right to left in the drawing, and this direction is identical to the photosensitive-member-arrangement direction, the direction represented by the arrow X in FIG. 6. A direction orthogonal to that direction on the belt surface is a belt width direction. It is ideal that an axial line L1 of the photosensitive member 2Y, a belt-width direction line L3, which is a virtual line extending in the width direction of the intermediate transfer belt 16, and an optical scan line L2 on the surface of the photosensitive member 2Y are parallel to one another. However, in the drawing, only the axial line L1 and the belt-width direction line L3 are parallel to each other. The optical scan line L2 is tilted at an angle θ from the axial line L1 on the surface of the photosensitive member 2Y. In the case of such a tilt, as shown, a line image transferred onto the intermediate transfer belt 16 is tilted at the angle θ from the belt-width direction. By contrast, as depicted in FIG. 10, when the optical scan line L2 and the belt-width direction line L3 are parallel to each other but the axial line L1 is tilted at the angle θ from these lines, the tilt angle of the intermediate transfer belt 16 is doubled, that is, 2θ. For this reason, to suppress a displacement in superposition of toner images for respective colors, it is an important factor to dispose each photosensitive member accurately and to have its axial line go along the belt width direction.

Figure 11:
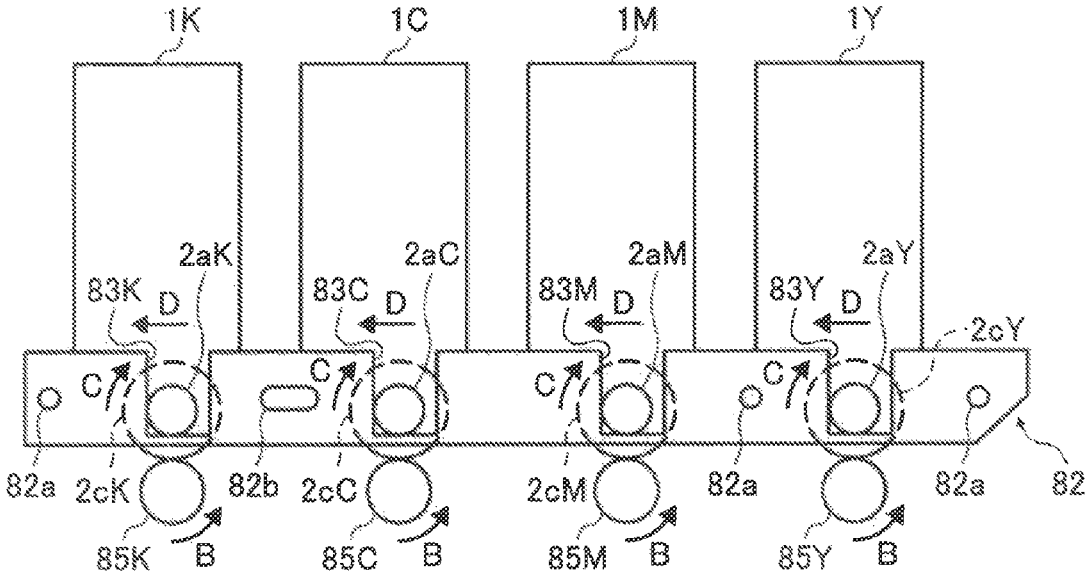
FIG. 11 is a front view for explaining a front pitch positioning member in the embodiment.

FIG. 11 is a front view for explaining a front pitch positioning member in the embodiment. FIG. 11 shows the front pitch positioning member 82 together with the process units 1Y, 1M, 1C, and 1K for respective colors. To the rear drum shafts of the photosensitive members not shown of the process units 1Y, 1M, 1C, and 1K for respective colors, photosensitive-member gears 2*a*Y, 2*c*M, 2*c*C, and 2*c*K are fixed. These photosensitive-member gears 2*a*Y, 2*c*M, 2*c*C, and 2*c*K have engaged therewith driving gears 85Y, 85M, 85C, and 85K from below in the vertical direction, the driving gears being fixed to motor shafts of driving motors for Y, M, C, and K not shown. The driving gears 85Y, 85M, 85C, and 85K rotate in the counterclockwise direction, a direction represented by an arrow B, in the drawing according to the driving of the driving motors. Then, the photosensitive-member gears 2*a*Y, 2*c*M, 2*c*C, and 2*c*K engaging with the driving gears 85Y, 85M, 85C, and 85K and, in turn, the photosensitive members for Y, M, C, and K not shown are rotated in a clockwise direction, a direction represented by an arrow A, in the drawing. In reaction to such engagement of these gears, a force to move from right to left of the printer, a direction represented by an arrow D, acts on each of the process units 1Y, 1M, 1C, and 1K and the front drum shaft and rear drum shaft of each photosensitive member. Upon reception of such a force, the front drum shafts 2*a*Y, 2*a*M, 2*a*C, and 2*a*K tending to move from right to left in the drawing abut on the left walls of the notches 83Y, 83M, 83C, and 83K for Y, M, C, and K, respectively, on the front pitch positioning member 82. With this, the photosensitive members, 2Y, 2M, 2C, and 2K, and the process units 1Y, 1M, 1C, and 1K are positioned in the photosensitive-member-arrangement direction. Here, at the rear end of the printer, similarly, the rear drum shafts not shown tending to move from right to left in the drawing abut on the left walls of the notches for Y, M, C, and K, respectively, on the rear pitch positioning member 92 shown in FIG. 6.

Figure 12:
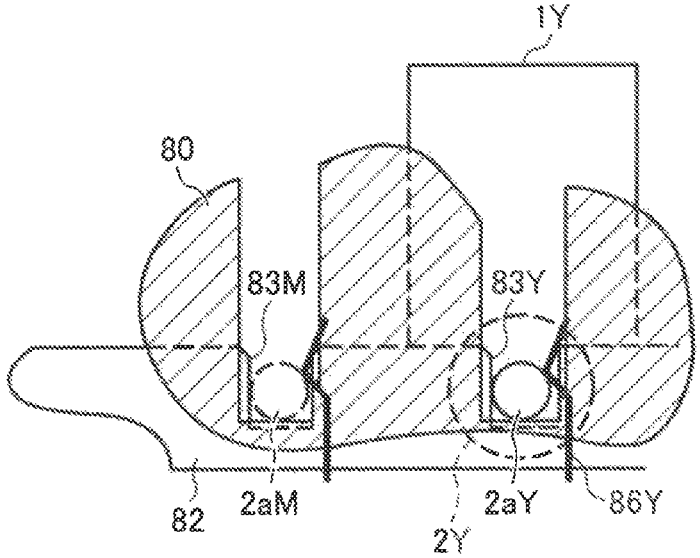
FIG. 12 is a front view for explaining a process unit for Y according to a first modification example of the embodiment.

As such, instead of causing each drum shaft to abut on the left wall of the notch by the reaction of engagement of the photosensitive-member gear and the driving gear, a biasing portion that biases the drum shaft onto the left wall or the right wall of the notch may be provided. For example, as depicted in FIG. 12, a leaf spring 86Y as a biasing portion may be provided to the front pitch positioning member 82, thereby biasing the front drum shaft 2*a*Y of the photosensitive member 2Y onto the left wall of the notch 83Y for Y. In this case, the biasing direction of the leaf spring 86Y is not identical to the photosensitive-member arrangement direction, but is preferably tilted to the orthogonal direction from the photosensitive-member arrangement direction, thereby causing the leaf spring 86Y to be biased in a direction with components of both directions. In the example shown, the photosensitive-member-arrangement direction is at an angle of 180 degrees/0 degree, while the biasing direction is at an angle on the order of 225 degrees/45 degrees With this, the front drum shaft 2*a*Y is biased not only in the photosensitive-member-arrangement direction but also in the orthogonal direction, thereby achieving positioning of the photosensitive member 2Y in the orthogonal direction with a higher accuracy. The same goes for the rear drum shafts. Also, the same goes for the drum shafts of the photosensitive members for other colors 2M, 2C, and 2K.

FIG. 12 is a front view for explaining a process unit for Y according to a first modification example of the embodiment. Here, instead of biasing the drum shaft onto the left wall of the notch by the leaf spring 86Y shown in FIG. 12 or the like, if the drum shaft is brought into contact with the left wall of the notch by the reaction of engagement of the gears as depicted in FIG. 11, the biasing portion, such as a leaf spring, can be omitted, thereby achieving a reduction in cost and weight.

Also, in any scheme being taken, a portion that allows the drum shaft to reliably abut on the inner wall of the notch is preferably provided. If the width of the notch is exactly equal to the diameter of the drum shaft, excessive friction between the inner wall of the notch and the drum shaft makes it practically impossible for the photosensitive member to be rotatingly driven. Therefore, the width of the notch is required to be larger than the diameter of the drum shaft anyhow. At minimum, a clearance of 0.05 millimeters is required. With such a clearance, a slight rattle of the drum shaft is inevitable in the notch in the photosensitive-member-arrangement direction.

In FIG. 11 explained above, the front pitch positioning member 82 has the notches 83Y, 83M, 83C, and 83K for Y, M, C, and K arranged with predetermined pitches in the photosensitive-member-arrangement direction, as explained above. Also, the front pitch positioning member 82 has three mount holes 82*a* aligned in line in the photosensitive-member-arrangement direction and a long hole 82*b* extending in the photosensitive-member-arrangement direction.

In the drawing, of the two pitch positioning members, only the front pitch positioning member 82 is depicted. However, the rear pitch positioning member not shown behind the front pitch positioning member 82 in the rear side of the drawing is exactly identical in shape to the front pitch positioning member 82.

As these front pitch positioning member 82 and rear pitch positioning member 92 in FIG. 6, those manufactured through the following process are desirable. That is, a first precursor, which is a precursor of the front pitch positioning member 82, and a second precursor, which is a precursor of the rear pitch positioning member 92 are processed by molding with the same mold. For example, when molten metal as the first precursor and the second precursor are poured into a mold to mold the front pitch positioning member 82 and the rear pitch positioning member 92, the same mold is used for molding. Also, when the sheet metal as the first precursor and the second precursor is punched with a die, the front pitch positioning member 82 and the rear pitch positioning member 9, are formed by punching with the same die. By using such front pitch positioning member 82 and rear pitch positioning member 92, it is possible to avoid deterioration in positioning accuracy of each of the photosensitive members 2Y, 2M, 2C, and 2K due to an error in molding process accuracy for both members.

Here, the front pitch positioning member 82 of the present printer is manufactured by punching the sheet metal as the precursor to form the outer edge of the front pitch positioning member 82, the four notches 83Y to 83K, the mount holes 82*a*, and the long hole 82*b* for positioning with respect to the front panel 80. Also, the rear pitch positioning member 92 is manufactured by punching with the same punching die as that of the front pitch positioning member 82. Therefore, it is possible to avoid deterioration in positioning accuracy of each of the photosensitive members 2Y, 2M, 2C, and 2K due to an error in molding accuracy of both of the pitch positioning members. By using the front pitch positioning member 82 and the rear pitch positioning member 92 with such a high positioning accuracy, an error in parallelism of the axial lines of the photosensitive members 2Y, 2M, 2C, and 2K can be suppressed on the order of 0.01. With this, the amount of displacement in superposition of toner images for respective colors on the intermediate transfer belt 16 can be suppressed to be equal to or smaller than 20 micrometers.

As for the front pitch positioning member 82 and the rear pitch positioning member 92, two sheets of metal as their precursors may be superposed to be simultaneously punched or separately punched. However, when the shape of the outer edge of the pitch positioning member is already molded with sheet metal and only the four notches, the mount holes, and the long hole are to be punched, it is required to adopt a scheme of simultaneously performing a punching process on the superposed two sheets of metal to form both of the pitch positioning members. This is because, if the shape of the outer edge is not punched together with the notches and others, due to an error in position of the sheets of metal on a work table in the punching apparatus, an error in relative position between the outer edge and the notches and others of the pitch positioning member occurs for each punching process. When the two superposed sheets of metal are simultaneously punched together, such an error in relative position can be eliminated between the front pitch positioning member 82 and the rear pitch positioning member 92 simultaneously punched together.

The front pitch positioning member 82 and the rear pitch positioning member 92 are obtained through punching from rear to front in the direction represented by the arrow Y in FIG. 6 explained above. In such pitch positioning members, burrs extending from rear to front in the drawing occur around portions subjected to punching. Here, burrs mean excess portions extending to the edge or the like when processing metal and plastic.

In general, burrs occurring on molded products obtained by punching are often removed by shaving and scrubbing with a tool. However, it is difficult to completely remove the burrs. In the four notches 83Y to 83K in FIG. 11 of the front pitch positioning member 82 and the four notches of the rear pitch positioning member, their left walls function as second abutting portions. If the burrs around these notches cannot be completely removed and the not-removed portions are changed in shape from a shape bent at an approximately right angle from the plate surface to a shape extending to a plate surface direction, the following problem occurs. That is, the drum shaft of the photosensitive member first collides with the burr-not-removed portion before colliding with the left wall of the notch, thereby making it impossible to appropriately perform positioning of the photosensitive member in the photosensitive-member-arrangement direction. Therefore, in the present printer, as the front pitch positioning member 82 and the rear pitch positioning member 92, those without removal of burrs bent from the left walls of the notches are used. With this, although with the burrs bent from the left walls being left as it is, the occurrence of a deterioration in positional accuracy due to collision of the drum shaft of the photosensitive member with the burrs can be suppressed.

However, with all burrs being left not-removed, the value of the products is decreased, and safety is also decreased, injuries may occur due to the burrs. To get around this problem, as the front pitch positioning member 82 and the rear pitch positioning member 92, those with burrs bent from a portion other than the left wall of the notch being all removed are used, and are mounted on the front panel 80 and the rear panel 90. With this, a decrease in value and safety of the products can be suppressed.

Figure 13:
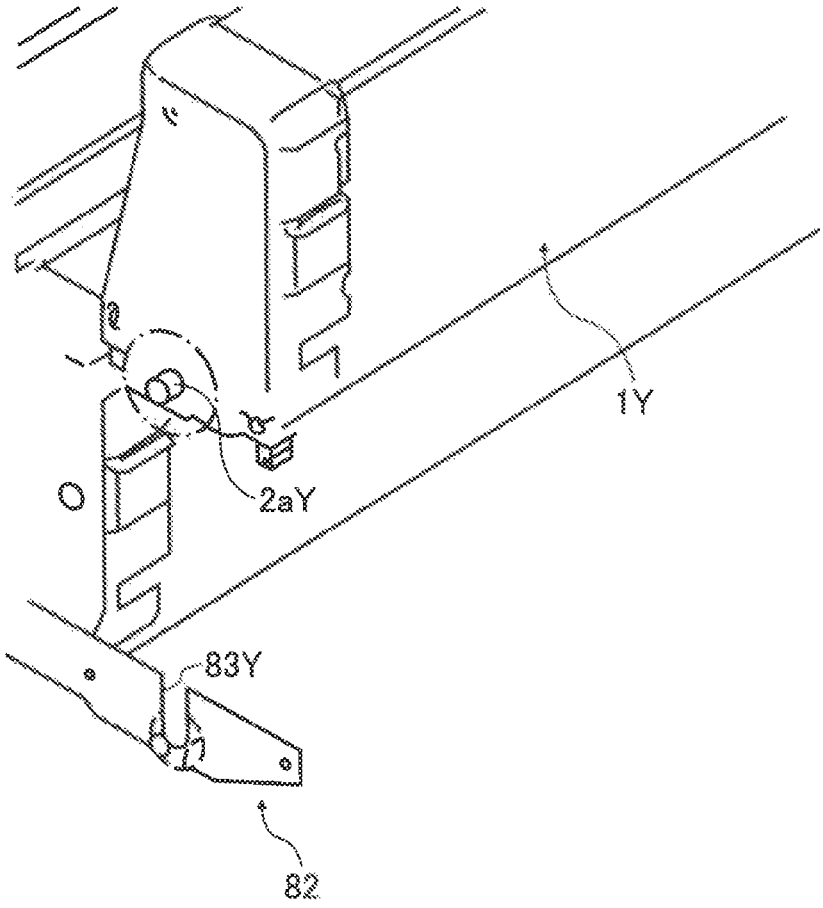
FIG. 13 is an enlarged perspective view explaining a front end of the process unit for Y in the embodiment.

FIG. 13 is an enlarged perspective view explaining a front end of the process unit for Y in the embodiment. In the present printer, as photosensitive-member gears 2*c*Y, 2*c*M, 2*c*C, and 2*c*K fixed to the rear drum shafts of the photosensitive members 2Y, 2M, 2C, and 2K for respective colors, helical gears each with a tooth abutting surface of the gear being tilted from the rotational axis direction are used. By using such helical gears, according to the engagement between the driving gears 85Y, 85M, 85C, and 85K and the photosensitive-member gears 2*c*Y, 2*c*M, 2*c*C, and 2*c*K, a biasing force is applied from a rear side, rear drum shaft side, to a front side, front drum shaft side, onto the photosensitive members 2Y, 2M, 2C, and 2K. With this biasing, the process units 1Y, 1M, 1C, and 1K containing the photosensitive members 2Y, 2M, 2C, and 2K are biased from rear to front, thereby each causing the front surface of the casing to abut on a surface of the front pitch positioning member 82 facing the rear pitch positioning member 92. With this abutment, each of the photosensitive members 2Y, 2M, 2C, and 2K is also positioned in its axial direction, the direction represented by the arrow Y in FIG. 6. For example, by taking the process unit 1Y for Y as an example, the process unit 1Y for Y is biased from the front to the rear of the printer. With this, as depicted by a one-dot-chain circle in FIG. 13, an area surrounding the front drum shaft 2*a*Y on the front surface of the casing is caused to abut on the front pitch positioning member 82. That is, the front pitch positioning member 82 as a member having the first abutting portions has a plurality of third abutting portions that individually abut on the front surface of the casing of the process unit as a carrier of each photosensitive member tending to move in the rotational axis direction and regulate the movements of the photosensitive members in the rotational axis direction.

When the photosensitive members 2Y, 2M, 2C, and 2K are positioned in the axial direction in this manner, the front surface of the casing of the process units 1Y, 1M, 1C, and 1K are required to make intimate contact with the side surface of the front pitch positioning member 82. On the other hand, as explained above, as the front pitch positioning member 82, the one with burrs bent from the left walls of the notches 83Y to 83K being left not-removed is used. The not-removed burrs are caused to collide with the front surface of the casing of the process units 1Y, 1M, 1C, and 1K. With this, there is a possibility that the front surface and the side surface of the front pitch positioning member 82 may not make intimate contact with each other.

To get around this problem, in the present printer, in FIG. 6 explained above, protruding surfaces of the not-removed burrs are directed not to the process units 1Y, 1M, 1C, and 1K but to a reversed direction. That is, the front pitch positioning member 82 is mounted on the front panel 80 to face the front panel 80. Also, the facing surface of the front panel 80 facing the rear panel 90 is provided with concave portions not shown for receiving these burrs. In such a configuration, it is possible to suppress a decrease in positional accuracy of the photosensitive members 2Y, 2M, 2C, and 2K in the axial direction due to collision of the not-removed burrs bent from the left walls of the front pitch positioning member 82 with the front surfaces of the process units 1Y, 1M, 1C, and 1K.

Here, in the printer, the rear pitch positioning member 92 is mounted on the rear panel 90 so that the protruding surface of the not-removed burrs faces each of the process units 1Y, 1M, 1C, and 1K. In such a configuration, there is a possibility that the not-removed burrs are caused to collide with the process units 1Y, 1M, 1C, and 1K. However, at the time of printing operation, as explained above, each of the process units 1Y, 1M, 1C, and 1K is pressed from rear to front of the printer with the engagement of the helical gears. Therefore, the not-removed burrs of the rear pitch positioning can be prevented from colliding with the rear surface of the casing of each of the process units 1Y, 1M, 1C, and 1K.

As explained above, in the present printer, the optical writing unit 70 is positioned in all of the X direction, the Y direction, and the Z direction orthogonal to one another, thereby sustaining an extremely high writing positional accuracy.

As the front pitch positioning member 82 and the rear pitch positioning member 92, those in a plate shape without having a stereoscopic structure are preferably used, as is the case of the present printer. With these front pitch positioning member 82 and rear pitch positioning member 92, a general-purpose sheet metal commercially available can be subjected to a punching process for easy formation, thereby achieving a reduction in cost. By contrast, if a member with a complex stereoscopic structure is used, the member has to be cast with a die, and a general-purpose member cannot be used as a precursor, thereby increasing cost.

Also, as the front pitch positioning member 82 and the rear pitch positioning member 92, those made of a conductive material, metal such as iron, in the present printer, is preferably used, as is the case of the present printer. In such a configuration, each of the photosensitive members 2Y, 2M, 2C, and 2K can be connected to ground via the front pitch positioning member 82 and the rear pitch positioning member 92 in contact with each of the photosensitive members 2Y, 2M, 2C, and 2K. Therefore, connection of each of the photosensitive members with ground wires is not required, and a reduction in cost and size can be achieved.

Furthermore, as the front pitch positioning member 82 and the rear pitch positioning member 92, those with their surface being plated with metal having a thickness on the order of several micrometers are preferably used, as is the case of the present printer, in the present printer, galvanization is used. In such a configuration, without affecting the positional accuracy, conductivity of each of the photosensitive members to the ground by the pitch positioning members can be increased, and corrosivity of the pitch positioning members can be suppressed.

Figure 14:
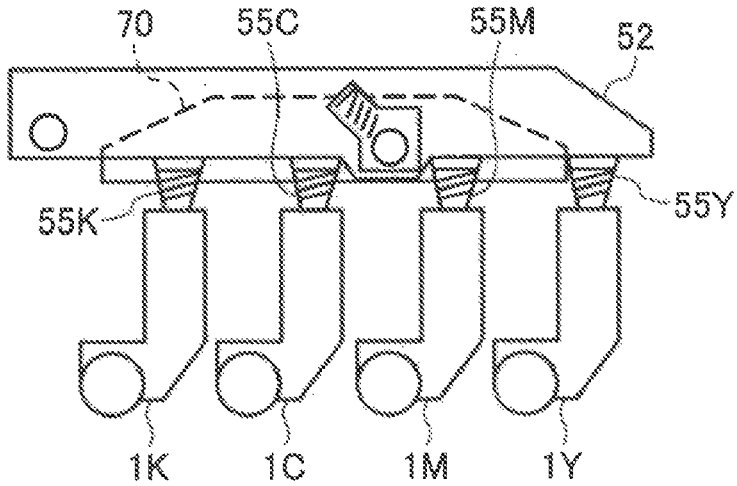
FIG. 14 is a front view for explaining the optical writing unit in the embodiment.

FIG. 14 is a front view for explaining the optical writing unit in the embodiment. FIG. 14 shows the optical writing unit 70 together with the cover frame 52 and four process units 1Y, 1M, 1C, and 1K. Although not shown in FIG. 3 for convenience, four process-unit biasing springs 55Y, 55M, 55C, and 55K for Y, M, C, K aligned and spaced away from one another are fixed under the lower surface of the front plate of the cover frame 52. Also, although not shown in FIG. 14, four similar process-unit biasing springs are fixed under the lower surface of the rear plate of the cover frame 52. When the upper cover 50 is closed, these process-unit biasing springs abut on the upper surfaces of the process units 1Y, 1M, 1C, and 1K to bias them from top to down in the vertical direction, in the Z direction. With this biasing, the front drum shaft 2*a*Y of the photosensitive member for Y shown in FIG. 6 above collides with the lower end of the guide groove 81Y for Y on the front panel 80, thereby positioning the photosensitive member for Y at the front end in the orthogonal direction, a direction orthogonal to the photosensitive-member-arrangement direction. Similarly, the rear drum shaft not shown of the photosensitive member for Y collides with the lower end of the guide groove 91Y for Y on the rear panel 90, thereby positioning the photosensitive member for Y at the rear end in the orthogonal direction. Similarly, the photosensitive members for M, C, and Y are positioned at both ends of the front and rear sides in the orthogonal direction.

These process-unit biasing springs as latent-image-carrier biasing portions can be provided in the cabinet. In this case, however, removal and attachment of the process units are hindered by the process-unit biasing springs. Therefore, these springs have to be removably provided. This forces an inconvenient operation of removing and attaching the process-unit biasing spring every time the process unit is removed or attached. By contrast, as in the present printer, the process-unit biasing springs are fixed to the cover frame 52, thereby allowing the process unit to move between a position where the process unit is biased and a position where the process unit is not biased. With such a movement, removal and attachment of the process unit is not hindered by the process-unit biasing spring. Therefore, the inconvenient operation can be omitted. Furthermore, by biasing the process unit with the process-unit biasing spring, the drum shaft of each photosensitive member is caused to collide with the lower end of the guide groove, thereby positioning each photosensitive member with a high accuracy in the orthogonal direction.

The example has been explained in which the guide grooves 81Y to 81K, 91Y to 91K extending in the vertical direction are provided to the front panel 80 and the rear panel 90 and the drum shafts of the photosensitive members are slidably moved through the guide grooves in the vertical direction to allow the process units 1Y, 1M, 1C, and 1K to be removed from and attached into the cabinet of the printer. However, there may be a case where it is difficult to adopt the configuration of slidably moving each of the process units 1Y, 1M, 1C, and 1K in the vertical direction. For example, a case is such that, in view of space-saving, a layout is adopted in which a protrusion is provided at the left or right end of each process unit, while a concave portion is provided at the opposite end, and the protrusion of the process unit fits in a concave portion of another process unit. In such a layout, when the process unit is tried to be pulled out in the vertical direction, the concave portion collides with the protrusion of another process unit, and therefore the process unit cannot be removed and attached in the vertical direction. However, the process unit can be removed and attached in a direction tilted from the vertical direction.

Figure 15:
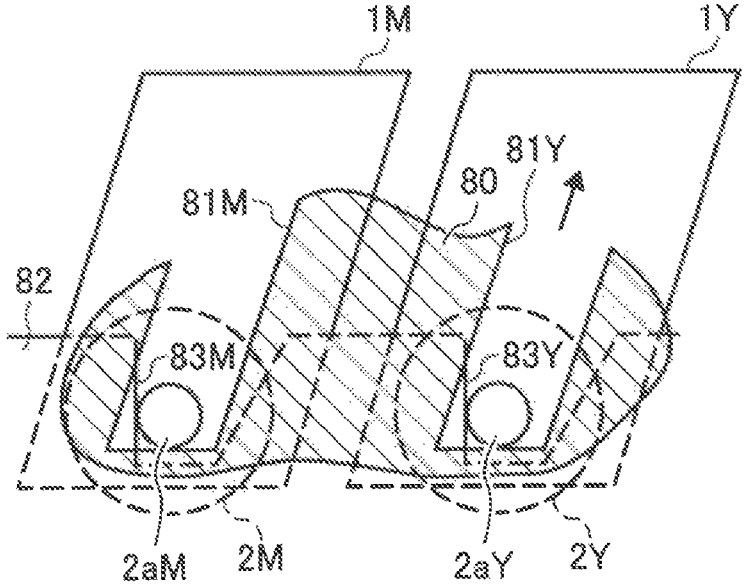
FIG. 15 is a front view for explaining a process unit for Y and according to another modification example of the embodiment.

FIG. 15 is a front view for explaining a process unit for Y and according to another modification example of the embodiment. FIG. 15 shows the modification example in which each process unit is removed or attached in a direction tilted from the vertical direction. In the drawing, only the process units 1Y and 1M for Y and M and their surrounding configuration are depicted. Each guide groove, for example, 81Y and 81M, on the front panel 80 are formed so as to extend in a direction tilted from the vertical direction. In the front pitch positioning member 82, if the four notches, for example, 83Y and 83M, aligned in the photosensitive-member-arrangement direction are shaped as being tilted from the vertical direction in a manner similar to that of each guide groove of the front panel 80, an error in dimension of each notch in the vertical direction causes an error to occur in the direction in which the photosensitive members are arranged. Therefore, the notches are formed so as to extend in the vertical direction, thereby allowing the front drum shafts, for example, 2*a*Y and 2*a*M, to reliably collide with the bottom surface of the notches. Furthermore, to avoid hindrance to the operability of attaching and removing the process unit due to a stop by the front drum shaft at the time of removal and attachment, the width of each guide groove on the front panel 80 is sufficiently wide. The rear panel 90 and the rear pitch positioning member 92 have a similar configuration.

An example of a printer adopting a one-component development scheme has been explained in which a one-component developer with a toner as a main ingredient without containing a magnetic carrier is used to develop a latent image. The present invention can also be applied to an image forming apparatus adopting a two-component development scheme using a two-component developer containing a magnetic carrier and toner.

Also, an example of a printer having a configuration in which the optical writing unit 70 is moved according to the opening and closing of the upper cover 50 has been explained. The embodiment of the present invention can also be applied to an image forming apparatus in which the optical writing unit 70 is solely rotated to move from a position facing the four process units to a waiting position. Furthermore, the embodiment of the present invention can be applied to an image forming apparatus in which the optical writing unit 70 is not rotated but is slidably moved.

In the printer according to the embodiment, the orthogonal direction, which is a direction orthogonal to the photosensitive-member-arrangement direction, the direction represented by the arrow X, is a vertical direction, that is, a gravity direction. In such a configuration, the drum shaft of each the photosensitive members 2Y, 2M, 2C, and 2K is caused to collide with the lower end of a relevant one of the guide grooves 81Y, 81M, 81C, 81K, 91Y, 91M, 91C, and 91K, which are the second abutting portions, thereby allowing each photosensitive member to be positioned in the orthogonal direction.

Furthermore, each of the four photosensitive members 2Y, 2M, 2C, and 2K are rotated about the drum shafts, the front drum shaft and the rear drum shaft, which are rotational shafts. Also, the front pitch positioning member 82, which is a member having the first abutting portions, has the third abutting portions that individually abut on front surface of the process units 1Y, 1M, 1C, and 1K, which are holding members that individually holds the four photosensitive members 2Y, 2M, 2C, and 2K tending to move in the rotational axis direction, and regulate the movements of the four photosensitive members 2Y, 2M, 2C, and 2K in the rotational axis direction. In such a configuration, the front pitch positioning member 82 can also position each of the photosensitive members 2Y, 2M, 2C, and 2K in the axial direction.

Still further, the photosensitive members are supported by a supporting member formed of the front panel 80 and the rear panel 90 each having guide portions, portions other than the lower portions of the guide grooves 81Y to 81K and the guide grooves 91Y to 91K, that guides the photosensitive members 2Y, 2M, 2C, and 2K from the photosensitive-member operating position, rotating position, to the optical writing unit 70. Also the orthogonal direction is a direction in which the photosensitive member is guided by the guide portion. In such a configuration, with the front panel 80 and the rear panel 90, each of the photosensitive members 2Y, 2M, 2C, and 2K and the process units 1Y, 1M, 1C, and 1K can be slidably guided in the guide portion so as to be removed from or attached to the supporting member, and can be positioned in the orthogonal direction.

Still further, as a latent-image writing device, the optical writing unit 70 that writes a latent image on each of the four photosensitive members 2Y, 2M, 2C, and 2K through optical scanning is used. As a member having the first abutting portions, two members are provided, that is, the front pitch positioning member 82 having the first abutting portions that each abut on the front drum shafts 2*a*Y, 2*a*M, 2*a*C, and 2*a*K at one end of the photosensitive members 2Y, 2M, 2C, and 2K in the optical scanning direction, and the rear pitch positioning member 92 having the first abutting portions that each abut on the rear drum shafts at the other end. Still further, as a member having the second abutting portions, two members are provided, that is, the front panel 80 having the second abutting portions that each abut on the front drum shafts 2*a*Y, 2*a*M, 2*a*C, and 2*a*K at one end of the photosensitive members 2Y, 2M, 2C, and 2K in the optical scanning direction, and the rear panel 90 having the second abutting portions that each abut on the rear drum shafts at the other end. In such a configuration, as explained above, the photosensitive members 2Y, 2M, 2C, and 2K are positioned at both ends in the direction from rear to front in the photosensitive-member-arrangement direction and the orthogonal direction. With this, a displacement in parallelism on a plane, X plane, in the arrangement direction of the photosensitive members 2Y, 2M, 2C, and 2K and a displacement in parallelism on a plane, Z plane, in the orthogonal direction can be both suppressed.

Still further, process-unit biasing springs 52Y, 52M, 52C, and 52K are provided, which are biasing portions that bias the process units 1Y, 1M, 1C, and 1K, which are holding members of the photosensitive members 2Y, 2M, 2C, and 2K, downward in the vertical direction, which is a gravity direction and a sliding movement direction. With this, the photosensitive members 2Y, 2M, 2C, and 2K can be reliably caused to abut on the second abutting portions to be positioned in the orthogonal direction.

Still further, the process-unit biasing springs 52Y, 52M, 52C, and 52K, which are biasing portions, are provided so as to be movable between a position where the process units 1Y, 1M, 1C, and 1K as holding units are biased and a position where these process units are not biased. This eliminates, as explained above, the need of an inconvenient operation of removing and attaching any of the process-unit biasing springs 52Y, 52M, 52C, and 52K every time any of the process units 1Y, 1M, 1C, and 1K is removed or attached. Still further, by biasing the process units 1Y, 1M, 1C, and 1K with the process-unit biasing springs 52Y, 52M, 52C, and 52K, the drum shafts of the photosensitive members 2Y, 2M, 2C, and 2K can be caused to reliably collide with the lower end of the guide grooves as the second abutting portions, thereby positioning each photosensitive member with high accuracy in the orthogonal direction.

Still further, the photosensitive members 2Y, 2M, 2C, and 2K and the process units 1Y, 1M, 1C, and 1K are biased in the photosensitive-member-arrangement direction and the rotating axis direction in reaction to the engagement of the photosensitive-member gears 2*c*Y, 2*c*M, 2*c*C, and 2*c*K transferring the driving forces to the photosensitive members 2Y, 2M, 2C, and 2K and the driving gears 85Y, 85M, 85C, and 85K. In such a configuration, no dedicated springs for biasing the photosensitive members 2Y, 2M, 2C, and 2K and the process units 1Y, 1M, 1C, and 1K in the photosensitive-member-arrangement direction or dedicated springs for biasing them in the rotational axis direction are required. With biasing in these directions, a reduction in cost and size can be achieved.

Still further, as the front pitch positioning member 82 and the rear pitch positioning member 92, which are members having the first abutting portions those made of metal with a stiffness higher than those of the front panel 80 and the rear panel 90, which are members having the second abutting portions, are used. With this, the positional accuracy in the arrangement direction of the photosensitive members 2Y, 2M, 2C, and 2K can be increased more than the positional accuracy in the orthogonal direction.

Still further, the front panel 80 and the rear panel 90, which are members having the second abutting portions, are supporting members that support the photosensitive members 2Y, 2M, 2C, and 2K and the process units 1Y, 1M, 1C, and 1K. Thus, by using the supporting members, the photosensitive members 2Y, 2M, 2C, and 2K can be positioned in the orthogonal direction.

Still further, the front panel 80 and the rear panel 90, which are members having the second abutting portions, are supporting members that also support the optical writing unit 70 as a latent-image writing device. By using these supporting members to support the process units 1Y, 1M, 1C, and 1K and the optical writing unit 70, the photosensitive members 2Y, 2M, 2C, and 2K can be positioned in the orthogonal direction.

Still further, as the front panel 80 and the rear panel 90, which are members having the second abutting portions, those made of resin with a gravity smaller than those of the front pitch positioning member 82 and the rear pitch positioning member 92, which are members having the first abutting portions, are used. By using such front panel 80 and rear panel 90, the photosensitive members 2Y, 2M, 2C, and 2K can be positioned in the orthogonal direction, direction represented by the arrow Z, with an accuracy required in design, and also light weight of the printer can be achieved.

Still further, as the front pitch positioning member 82 and the rear pitch positioning member 92, which are members having the first abutting portions, those made of metal are used. With this, the photosensitive members 2Y, 2M, 2C, and 2K can be positioned in the arrangement direction, the direction represented by the arrow X, with a relatively high accuracy required in design.

Still further, as the front panel 80 and the rear panel 90, which are members having the second abutting portions, those made of resin are used. Therefore, they can be easily molded compared with those made of metal, thereby reducing cost.

Still further, as the front pitch positioning member 82 and the rear pitch positioning member 92, which are members having the first abutting portions, those made of metal, which is a conductive material, are used. Therefore, through these pitch positioning members, each of the photosensitive members 2Y, 2M, 2C, and 2K can be connected to the ground. Here, only in view of ground connection of each of the photosensitive members 2Y, 2M, 2C, and 2K without connection through dedicated ground wires, in place of the front pitch positioning member 82 and the rear pitch positioning member 92, the front panel 80 and the rear panel 90 may be configured of a conductive material. In this case, however, it is difficult to effectively achieve light weight.

Still further, for each of the photosensitive members 2Y, 2M, 2C, and 2K, at least the photosensitive member, and the charging device that uniformly charges the surface of the photosensitive member and the developing device are integrally formed as each of the process units 1Y, 1M, 1C, and 1K held by the common holding unit and removable from the printer body. Therefore, the photosensitive members 2Y, 2M, 2C, and 2K can be integrally removed and attached together with their peripheral devices.

According to the embodiment of the present invention, a member having the first abutting portions serving as positioning portions each for positioning a latent image carrier in an arrangement direction, a predetermined direction, and a member having the second abutting portions serving as positioning portions each for positioning the latent image carrier in an orthogonal direction are separately provided. Therefore, as these members, those made of different materials can be used. Therefore, positioning each latent image carrier in the arrangement direction and positioning each latent image carrier in the orthogonal direction can be performed by positioning portions made of materials each suited for a positioning accuracy required in design, thereby reducing cost and weight.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus including a plurality of latent image carriers that are disposed in a first direction substantially parallel to a sub scanning direction thereof, and a latent-image writing device that writes latent images on surfaces of the latent image carriers, the image forming apparatus comprising:

a plurality of first abutting portions, wherein a latent image carrier among the latent image carriers or a holding member among a plurality of holding members, each of which holds a latent image carrier among the latent image carriers, abuts with a first abutting portion among the first abutting portions so as to regulate movements of corresponding latent image carrier in the first direction;

a plurality of second abutting portions, wherein a latent image carrier among the latent image carriers or a holding member among the holding members abuts with a second abutting portion among the second abutting portions so as to regulate movements of corresponding latent image carrier in a second direction that is substantially orthogonal to the first direction;

a first member that is provided with the first abutting portions; and a second member that is provided with the second abutting portions, the second member being formed separately to the first member, and the second member being formed of different material from that of the first member.

2. The image forming apparatus according to claim 1, wherein the second direction is a gravity direction.

3. The image forming apparatus according to claim 1, wherein each of the latent image carriers rotates about a rotational axis as a third direction, the first member or the second member includes a plurality of third abutting portions, wherein a latent image carrier among the latent image carriers or a holding member among the holding members abuts with a third abutting portion among the third abutting portions so as to regulate movements of corresponding latent image carrier in the third direction.

4. The image forming apparatus according to claim 3, further comprising a biasing portion that biases the latent image carriers or the holding members in any one of the first direction, the second direction, the third direction, and a slide-moving direction thereof.

5. The image forming apparatus according to claim 4, wherein the biasing portion is movably provided between a position being able to bias the latent image carriers or the holding members and a position being unable to bias the latent image carriers or the holding members.

6. The image forming apparatus according to claim 3, further comprising a driving unit that generates a driving force; and a gear engagement unit that transmits the driving force to the latent image carriers, the gear engagement unit including a plurality of engaged gears that biases the latent image carriers or the holding members in the first direction and in the third direction due to a reaction force of the engaged gears.

7. The image forming apparatus according to claim 1, further comprising a supporting member that supports at least one of the latent image carriers and the holding members, the supporting member being provided with a guiding portion that guides at least one of the latent image carriers and the holding members toward an operation position of the latent image carriers from a position of the latent-image writing device, in which a direction being substantially the second direction.

8. The image forming apparatus according to claim 1, wherein the latent-image writing device writes the latent image due to an optical scanning, the first member is configured to be a first first-member and a second first-member each having the first abutting portions, the first first-member being at one end in a main optical scanning direction on the latent image carriers, and the second first-member being at another end in the main optical scanning direction, and the second member is configured to be a first second-member and a second second-member each having the second abutting portions, the first second-member being at one end in the main optical scanning direction, and the second second-member being at another end in the main optical scanning direction.

9. The image forming apparatus according to claim 1, wherein the first member has a stiffness higher than that of the second member.

10. The image forming apparatus according claim 1, wherein the second member is a supporting member that supports the latent image carriers.

11. The image forming apparatus according claim 1, wherein the second member is a supporting member that supports the latent-image writing device.

12. The image forming apparatus according to claim 1, wherein the second member has a specific gravity smaller than that of the first member.

13. The image forming apparatus according to claim 12, wherein the first member is made of metal.

14. The image forming apparatus according to claim 12, wherein the second member is made of resin.

15. The image forming apparatus according to claim 1, wherein at least one of the first member and the second member is made of conductive material.

16. The image forming apparatus according to claim 1, further comprising a charging unit that uniformly charges a surface of the latent image carrier;

a developing unit that develops the latent image present on the surface; and a common holding member that holds the latent image carrier, the charging unit, and the developing unit as one process unit, the common holding member being detachably attached to a main body of the image forming apparatus so that the process unit be detachably attached to the main body.

17. A supporting mechanism for use in an image forming apparatus that is including a plurality of latent image carriers that are disposed in a first direction substantially parallel to a sub scanning direction thereof, and a latent image writing device that writes latent images on surfaces of the latent image carriers, the supporting mechanism comprising:

a plurality of first abutting portions, wherein a latent image carrier among the latent image carriers or a holding member among a plurality of holding members, each of which holds a latent image carrier among the latent image carriers, abuts with a first abutting portion among the first abutting portions so as to regulate movements of corresponding latent image carrier in the first direction;

a plurality of second abutting portions, wherein a latent image carrier among the latent image carriers or a holding member among the holding members abuts with a second abutting portion among the second abutting portions so as to regulate movements of corresponding latent image carrier in a second direction that is substantially orthogonal to the first direction;

a first member that is provided with the first abutting portions; and a second member that is provided with the second abutting portions, the second member being formed separately to the first member, and the second member being formed of different material from that of the first member.

* * * * *